US008263543B2

(12) United States Patent
Panandiker et al.

(10) Patent No.: US 8,263,543 B2
(45) Date of Patent: Sep. 11, 2012

(54) FABRIC CARE COMPOSITIONS COMPRISING ORGANOSILOXANE POLYMERS

(75) Inventors: Rajan Keshav Panandiker, West Chester, OH (US); Kerry Andrew Vetter, Cincinnati, OH (US); Bernard William Kluesener, Harrison, OH (US); Iskender Yilgor, Istanbul (TK); Christian Herzig, Waging am See (DE); Richard Becker, Burghausen (DE); Rafael Trujillo Rosaldo, Mason, OH (US); Leslie Dawn Waits, Cincinnati, OH (US); Janine A. Flood, Cincinnati, OH (US); Keith Homer Baker, Cincinnati, OH (US); Jennifer Beth Ponder, Cincinnati, OH (US); Mark Gregory Solinsky, Cincinnati, OH (US); Matthew Scott Wagner, Cincinnati, OH (US); Pradipta Sarkar, Blue Ash, OH (US); Emily Suzanne Klinker, Lindenwald, OH (US); Julie Ann O'Neil, Dillsboro, IN (US)

(73) Assignee: The Procter & Gamble Company, Cincinnati, OH (US)

( * ) Notice: Subject to any disclaimer, the term of this patent is extended or adjusted under 35 U.S.C. 154(b) by 225 days.

(21) Appl. No.: 12/752,860

(22) Filed: Apr. 1, 2010

(65) Prior Publication Data

US 2010/0267601 A1 Oct. 21, 2010

Related U.S. Application Data

(60) Provisional application No. 61/170,150, filed on Apr. 17, 2009.

(51) Int. Cl.
*C11D 3/37* (2006.01)

(52) U.S. Cl. ..... 510/466; 510/475

(58) Field of Classification Search ..... 510/466, 510/475

See application file for complete search history.

(56) References Cited

U.S. PATENT DOCUMENTS

| | | | |
|---|---|---|---|
| 3,664,961 | A | 5/1972 | Norris |
| 3,919,678 | A | 11/1975 | Penfold |
| 4,137,180 | A | 1/1979 | Naik et al. |
| 4,144,226 | A | 3/1979 | Crutchfield et al. |
| 4,222,905 | A | 9/1980 | Cockrell, Jr. |
| 4,239,659 | A | 12/1980 | Murphy |
| 4,284,532 | A | 8/1981 | Leikhim et al. |
| 4,597,898 | A | 7/1986 | Vander Meer |
| 4,659,802 | A | 4/1987 | Rubingh et al. |
| 4,663,071 | A | 5/1987 | Bush et al. |
| 4,676,921 | A | 6/1987 | Vander Meer |
| 4,789,491 | A | 12/1988 | Chang et al. |

(Continued)

FOREIGN PATENT DOCUMENTS

DE 19817776 A1 10/1999

(Continued)

OTHER PUBLICATIONS

International Search Report, dated Aug. 2, 2010 containing 103 pages.

*Primary Examiner* — John Hardee

(74) *Attorney, Agent, or Firm* — James F. McBride; Melissa G. Krasovec; Steven W. Miller

(57) ABSTRACT

The present composition relates to fabric care compositions comprising an organosiloxane polymer. Methods of using such compositions including contacting a fabric with the composition and rinsing the fabric are also disclosed.

18 Claims, 3 Drawing Sheets

U.S. PATENT DOCUMENTS

| | | | |
|---|---|---|---|
| 4,800,026 | A | 1/1989 | Coffindaffer et al. |
| 4,911,852 | A | 3/1990 | Coffindaffer et al. |
| 5,126,060 | A | 6/1992 | Puentes-Bravo et al. |
| 5,290,459 | A | 3/1994 | Puentes-Bravo et al. |
| 5,332,513 | A | 7/1994 | Doms et al. |
| 5,358,647 | A | 10/1994 | Puentes-Bravo et al. |
| 5,460,736 | A | 10/1995 | Trinh et al. |
| 5,563,231 | A | 10/1996 | Barringer, Jr. et al. |
| 5,750,990 | A | 5/1998 | Mizuno et al. |
| 5,830,845 | A | 11/1998 | Trinh et al. |
| 6,194,374 | B1 | 2/2001 | Crutzen et al. |
| 6,492,322 | B1 | 12/2002 | Cooper et al. |
| 6,514,488 | B1 | 2/2003 | Cauwet-Martin et al. |
| 6,627,216 | B2 | 9/2003 | Brandt et al. |
| 6,815,069 | B2 | 11/2004 | Hohberg et al. |
| 6,855,680 | B2 | 2/2005 | Smerznak et al. |
| 6,958,154 | B2 | 10/2005 | Andolino Brandt et al. |
| 6,958,155 | B2 | 10/2005 | Lu et al. |
| 7,018,962 | B2 | 3/2006 | Bloch et al. |
| 7,153,924 | B2 | 12/2006 | Kuepfer et al. |
| 7,319,120 | B2 | 1/2008 | Herzig et al. |
| 7,427,648 | B2 | 9/2008 | Ochs et al. |
| 2003/0176613 | A1 | 9/2003 | Hohberg et al. |
| 2004/0204337 | A1 | 10/2004 | Corona et al. |
| 2004/0254325 | A1 | 12/2004 | Kuepfer et al. |
| 2005/0137327 | A1 | 6/2005 | Ziche |
| 2005/0164905 | A1 | 7/2005 | Chawla et al. |
| 2005/0272862 | A1 | 12/2005 | Ochs et al. |
| 2006/0089293 | A1 | 4/2006 | Frankenbach |
| 2006/0155051 | A1 | 7/2006 | Herzig |
| 2006/0205631 | A1 | 9/2006 | Smerznak et al. |
| 2007/0054835 | A1 | 3/2007 | Corona et al. |
| 2009/0181877 | A1 | 7/2009 | Mcginnis et al. |
| 2009/0311211 | A1 | 12/2009 | Chrobaczek et al. |
| 2010/0048795 | A1 | 2/2010 | Kennan et al. |
| 2010/0210809 | A1 | 8/2010 | Simon et al. |
| 2010/0267601 | A1 | 10/2010 | Panandiker et al. |
| 2011/0033411 | A1 | 2/2011 | Wagner et al. |

FOREIGN PATENT DOCUMENTS

| | | | |
|---|---|---|---|
| DE | 10 2005 01727 | A1 | 4/2006 |
| EP | 0692567 | A1 | 1/1996 |
| EP | 1 672 006 | A1 | 6/2006 |
| JP | 11158779 | A2 | 6/1999 |
| JP | 04163374 | A2 | 10/2008 |
| JP | 2009203592 | A2 | 9/2009 |
| WO | WO 2006/063659 | A1 | 6/2006 |
| WO | WO-2009/021989 | A1 | 2/2009 |
| WO | WO-2009112418 | A1 | 9/2009 |

FABRIC CARE COMPOSITIONS COMPRISING ORGANOSILOXANE POLYMERS

FIELD OF THE INVENTION

The present disclosure relates to compositions and systems comprising organosiloxane polymers and methods of making and using the same.

BACKGROUND OF THE INVENTION

When fabrics are washed using conventional washing and drying techniques, such fabrics often become wrinkled. This is particularly true for fabrics which contain a high content of cellulosic fibers, such as cotton, rayon and ramie. Without being limited by theory, it is believed that the hydrogen bonding between the cellulose chains within these fibers is disrupted by water and mechanical action during the washing and drying processes, and are not properly reformed upon drying. This gives garments an undesired wrinkled appearance, which can be further exacerbated if the clothes are left in the automatic tumble dryer after the drying cycle is completed.

While mechanical wrinkle reduction techniques such as the application of heat and pressure (e.g. ironing and steaming) can be used to reduce or remove wrinkles, these methods are inconvenient and time consuming, and the effect generally deteriorates when the garment is worn.

Crosslinking agents such as dimethyloldihydroxyethyleneurea and butanetetracarboxylic acid can be used in the textile mills during the fabric manufacture to reduce the wrinkle formation. Though these agents can provide a wrinkle benefit, such agents generally significantly reduce fiber strength, reducing the lifespan of the textile, and entail aggressive curing conditions that are not suitable for home application.

Many attempts have been made to reduce wrinkles by chemical ingredients which can be added to the wash, rinse or applied as a spray after the fabric is retrieved from the dryer. See, for example, U.S. Pat. No. 4,911,852. Agents such as ethoxylated organosilicones, polyalkylene oxide modified polydimethylsiloxanes, betaine siloxane copolymers, and alkyl lactam siloxane copolymers may be used. However, these agents are generally not chemically stable in aqueous acid or alkaline environments and are therefore generally unsuitable for fabric softeners that are typically formulated at a low pH. Moreover, these agents do not typically deposit effectively on the fabric when they are incorporated into laundry detergents.

Curable amine functional silicones have also been suggested for reducing wrinkles in fabrics. See, for example, U.S. Pat. No. 4,800,026. However, amino-containing silicones are known to interact with a material comprising an aldehyde and/or ketone group, such as perfumes, causing yellowing of the finished product. This is problematic, in that perfume ingredients often contain these chemical groups, and delivering a perfume benefit to the consumer is highly desired.

As such, there remains a need for fabric care compositions that provide a wrinkle benefit to fabrics, and which can be formulated with a wide variety of materials comprising an aldehyde and/or ketone group, such as perfume ingredients.

There is also a need for fabric care composition that provide unique fabric feel benefits.

There is also a need for fabric care active that provide efficient fabric deposition through laundry wash/rinse cycles.

SUMMARY OF THE INVENTION

The present disclosure relates to fabric care compositions comprising an organosiloxane polymer for providing a wrinkle benefit to a fabric. Methods of using such compositions including contacting a fabric with the fabric care composition are also disclosed.

DETAILED DESCRIPTION OF THE INVENTION

Figure 1:
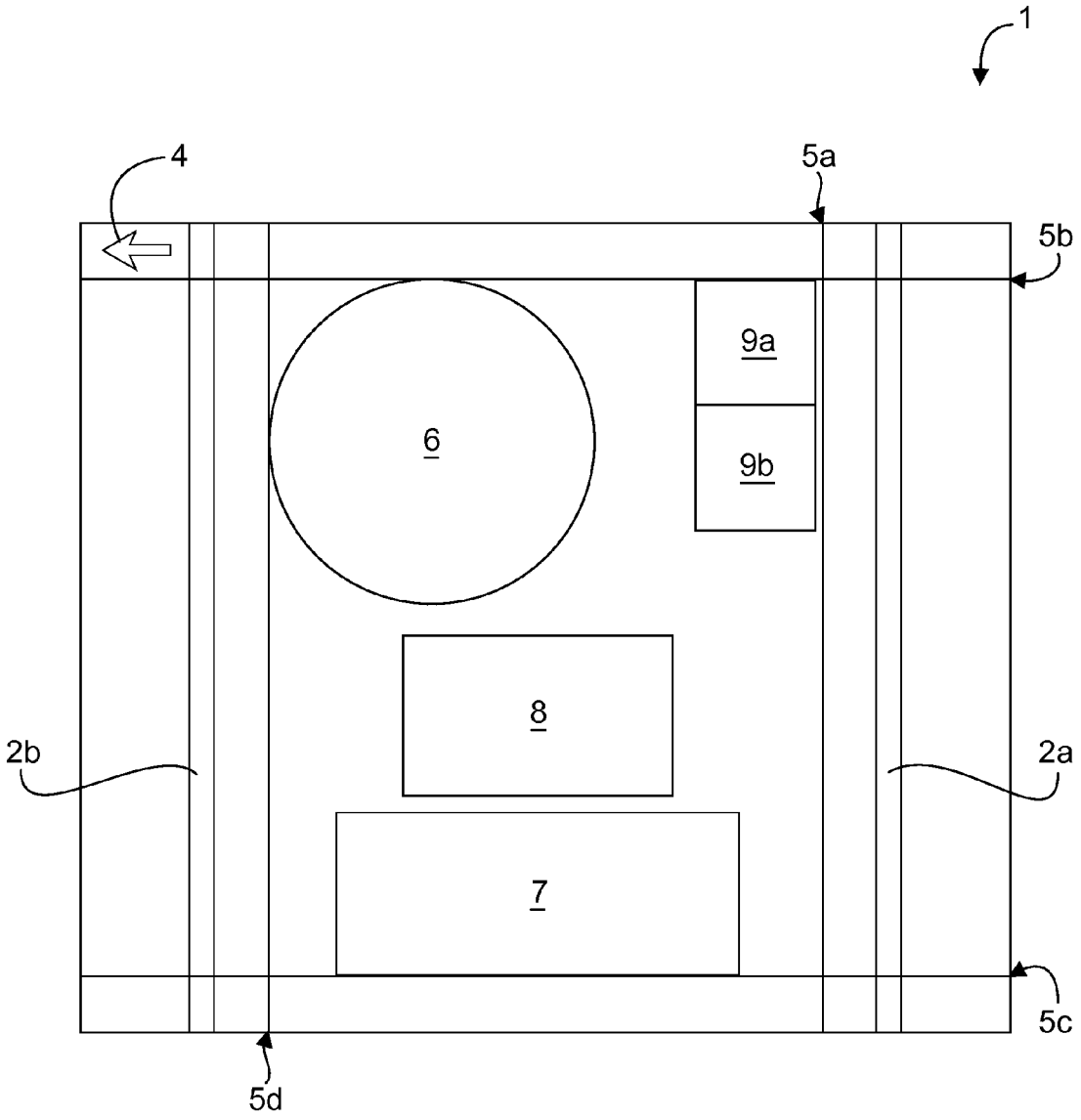
FIG. 1 is a top view of a fabric cloth showing orientation and measurement locations.

As used herein, the articles "a" and "an" when used in a claim, are understood to mean one or more of what is claimed or described.

As used herein, the term "comprising" means various components conjointly employed in the preparation of the compositions of the present disclosure. Accordingly, the terms "consisting essentially of" and "consisting of" are embodied in the term "comprising."

As used herein, "fabric care compositions" include compositions for handwash, machine wash, additive compositions, compositions suitable for use in the soaking and/or pretreatment of stained fabrics, rinse-added compositions, sprays and ironing aids. The fabric care compositions may take the form of, for example, liquid and granule laundry detergents, fabric conditioners, other wash, rinse, dryer-added products such as sheet, and sprays, encapsulated and/or unitized dose compositions, ironing aids, fabric sprays for use on dry fabrics, or as compositions that form two or more separate but combinedly dispensable portions. Fabric care compositions in the liquid form are generally in an aqueous carrier, and generally have a viscosity from about 1 to about 2000 centipoise (1-2000 mPa*s), or from about 200 to about 800 centipoises (200-800 mPa*s). Viscosity can be determined by conventional methods readily known in the art. The term also encompasses low-water or concentrated formulations such as those containing less than about 50% or less than about 30% or less than about 20% water or other carrier.

As used herein, the terms "include," "includes," and "including" are meant to be non-limiting.

Unless otherwise noted, all component or composition levels are in reference to the active portion of that component or composition, and are exclusive of impurities, for example, residual solvents or by-products, which may be present in commercially available sources of such components or compositions.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Compositions

Without being limited by theory, Applicants believe that, in contrast to known silicones that provide only lubricity to a fabric, the organosiloxane polymers described herein unexpectedly reduce fabric wrinkling by two mechanisms: the siloxane portion of the copolymer provides lubricity to the fabric, whereas the organic portion of the molecule imparts elasticity. Applicants believe that, due to the dual mechanism of action, the organosilicone polymers described herein provide superior wrinkle reduction compared to silicones which operate by lubrication alone.

The fabric care compositions disclosed herein may comprise an organosiloxane polymer, at least one surfactant, and at least one material containing an aldehyde and/or ketone group. The surfactant may be a nonionic surfactant, cationic surfactant, anionic surfactant, or mixtures thereof, In one aspect, the fabric care compositions may comprise from about 0.01% to about 20%, or about 0.1% to about 10%, or about from about 1.0% to about 8% by weight of the fabric care composition of the organosiloxane polymer. In a further aspect, the organosiloxane polymer may comprise less than about 0.3 milliequivent/g or less than about 0.2 milliequivalent/g of primary or secondary amino groups.

The organosiloxane polymer described herein may be incorporated in the fabric care composition as a dispersion. In this aspect, the fabric care compositions may comprise at least one emulsifier to assist and/or stabilize the organosiloxane polymer dispersion in the carrier. In some aspects, the amount of emulsifier may be from about 1 to about 75 parts per 100 weight parts of the dispersion. Suitable emulsifiers include anionic, nonionic, cationic surfactants, or mixtures thereof.

Organosiloxane Polymers

The organosiloxane polymers for use in the disclosed fabric care compositions may comprise A. A first repeat unit of structure of Formula I:

Formula I

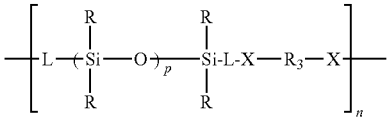

wherein:

(i) each X may be independently selected from the group consisting of

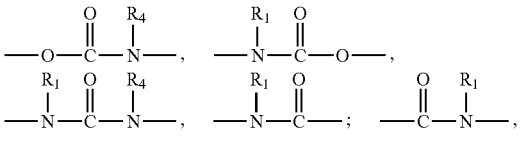

and combinations thereof;

(ii) each L may be a linking bivalent alkylene radical, or independently selected from the group consisting of

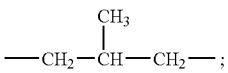

-continued

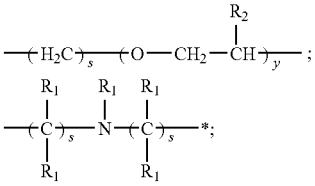

—$(CH_2)_s$—, and combinations thereof;

(iii) each R may be independently selected from selected from the group consisting of H, $C_1$-$C_{20}$ alkyl, $C_1$-$C_{20}$ substituted alkyl, $C_6$-$C_{20}$ aryl, $C_6$-$C_{20}$ substituted aryl, alkylaryl, —$OR_2$, and combinations thereof;

(iv) each $R_1$ may be independently selected from the group consisting of H, $C_1$-$C_8$ alkyl, substituted alkyl, and combinations thereof;

(v) each $R_2$ may be independently selected from the group consisting of H, $C_1$-$C_4$ alkyl, substituted alkyl, aryl, substituted aryl, and combinations thereof;

(vi) each $R_3$ may be a bivalent radical independently selected from aromatic radicals, aliphatic radicals, cycloaliphatic radicals, and combinations thereof, therein the bivalent radical may comprise from about 2 to about 30 carbon atoms; and (vii) each $R_4$ may be independently selected from the group consisting of H, $C_1$-$C_{20}$ alkyl with molecular weight from 150 to 250 daltons, aryl, substituted alkyl, cycloalkyl, and combinations thereof;

(viii) p may be an integer of from about 2 to about 1000, or from about 10 to about 500;

(ix) s may be is an integer of from about 2 to about 8;

(x) y is an integer of from about 0 to about 50, or about 1 to about 10;

(xi) n may be an integer of from about 1 to about 50;

B a surfactant selected from the group consisting of anionic, cationic, amphoteric, nonionic surfactants, and combinations thereof; and C a material containing an aldehyde and/or ketone group.

In a further aspect, the organosiloxane polymer may comprise a second repeat unit of the structure of Formula II:

Formula II to produce a copolymer of the repeat units of the structure of Formula III Formula III

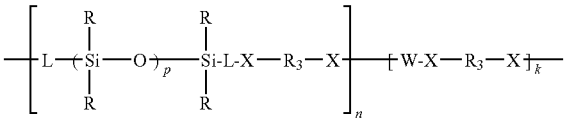

wherein:

(i) W is an alkylene radical derived from an organic molecule containing at least two functional groups selected from the group consisting of amino, hydroxyl, carboxyl, and combinations thereof;

(ii) k is an integer of from 0 to about 100.

In one aspect, R may be selected from the group consisting of methyl, ethyl, propyl, isopropyl, butyl, pentyl, hexyl, octyl, decyl, dodecyl, cycloalkyl, aryl especially phenyl, naphthyl, arylalkyl especially benzyl, phenylethyl, and combinations thereof.

In a further aspect, the fabric care composition may comprise an organosiloxane polymer having the structure of Formula III wherein:

(i.) R may be methyl;

(ii.) $R_1$ may be H;

(iii.) each $R_2$ may be independently selected from the group consisting of H, $C_1$-$C_4$ alkyl, substituted alkyl, aryl, substituted aryl, and combinations thereof;

(iv.) $R_3$ may be selected from the group consisting of $C_2$-$C_{12}$ $C_6$ alkylene radicals and combinations thereof (v.) $R_4$ may be selected from the group consisting of alkyl, substituted alkyl with 1-6 tertiary amine groups with molecular weight from 140 to 250 Dalton, and combinations thereof;

(vi.) L may be

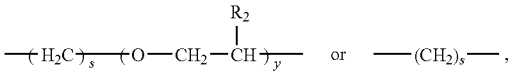

(vii.) X may be selected from the group consisting of,

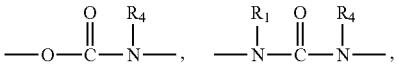

and combinations thereof;

(viii.) p may be an integer of from about 30 to about 300

(ix.) y may be an integer of from about 0 to about 50, or about 1 to about 10 and (x.) s may be an integer of about 1 to about 50.

The second repeat unit may be added as a diluent, to modify the physical properties or alter the solubility of the organosiloxane polymer, or to improve the physical stability of the organosiloxane polymer emulsion.

In one aspect, the synthesis of organosiloxane polymer involves a conventional polycondensation reaction between a polysiloxane containing hydroxy functional groups or amine functional groups at the ends of its chain (for example, α,ω-dihydroxyalkylpolydimethylsiloxane or α,ω-diaminoalkylpolydimethylsiloxane or α-amino,ω-hydroxyalkylpolydimethylsiloxane) and a diisocyanate to produce the organosiloxane polymers as shown below:

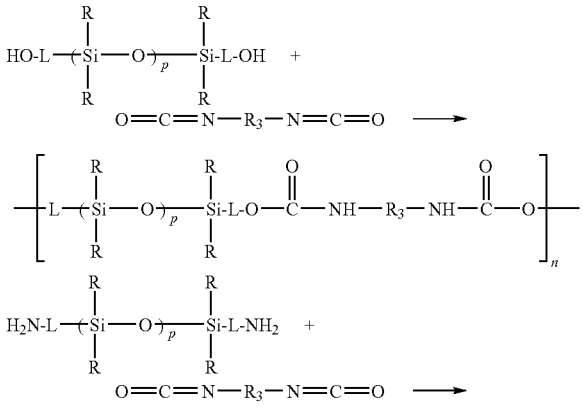

-continued

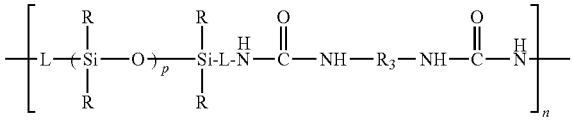

Optionally, organopolysiloxane oligomers containing a hydroxyalkyl functional group or an aminoalkyl functional group at the ends of its chain may be mixed with an organic diol or diamine coupling agent in a compatible solvent. The mixture may be then reacted with a diisocyanate. Diisocyanates that may be used include alkylene diisocyanate, isophorone diisocyanate, toluene diisocyanate, diphenylmethane diisocyanate, naphthalene diisocyanate, dicyclohexylmethane diisocyanate, xylene diisocyanate, cycloxyl diisocyanate, tolylene+diisocyanate, and combinations thereof. In one aspect, the alkylene diisocyanates include hexamethylene diisocyanate, butylene diisocyanate, or mixtures thereof.

In one aspect, the organosiloxane polymers of Formula III have a random distribution of first and second repeat units. In another aspect, polysiloxane may be used in stoichiometric excess such that the organosilicone polymer produced may comprise a polysiloxane at each end. In a second aspect, isocyanate may be used in stoichiometric excess such that the organosiloxane polymer produced has a isocyanate group at each end of the polymer chain, producing a diisocyanate. In such case, the organosiloxane polymer is reacted in a second step with a coupling agent to produce a polysiloxane polymer of Formula III. The polysiloxane polymer made using the two-step process generally has longer blocks of polysiloxanes joined together by one or more coupling agent.

Suitable coupling agents include organic molecules that contain at least two groups capable of reacting with an isocyanate group under appropriate reaction conditions. In one aspect, the coupling agents are selected from the group consisting of diols, polyols, polyetheramines, aminoalcohols, diamines, polyamines, chain extenders, crosslinkers, dispersion stabilizers, chain blockers, and combinations thereof, such as those described in *Szycher's Handbook of Polyurethanes* by Michael Szycher, CRC Press (1999). Suitable diols include di, tri and polyhydric alcohols, for example ethylene glycol, 1,3-propanediol, 1,4-butanediol, 1,5-pentanediol, 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol, cyclohexandedimethanol, alkyl propane diol and their derivatives, and combinations thereof. Suitable polyols include polyether polyols, polyester polyols, and polycarbonate polyols. Polyether polyols include glycols with two or more hydroxy groups, such as those made by ring-opening polymerization and/or copolymerization of ethylene oxide, propylene oxide, trimethylene oxide, tetrahydrofuran and 3-methyltetrahydrofuran. In one aspect, polyether polyols include polyalkylene glycol, polyethylene glycol, polypropylene glycol, polybutylene glycol and their copolymers, polymers of tetrahydrofuran and alkylene oxide, Poly BD and polytetramethylene etherglycol (PTMEG) and combinations thereof. Suitable polyester polyols include polyalkylene terephthalate, polyalkylene isophthalates polyalkylene adipate, polyalkylene glutarate, or polycaprolactone. Suitable polycarbonate polyols include those carbonate glycols with two or more hydroxy groups, produced by condensation polymerization of phosgene, chloroformic acid ester, dialkyl carbonate or diallyl carbonate and aliphatic polyols. Suitable polyols for preparing the polycarbonate polyols include diethylene glycol, 1,3-propanediol, 1,4-butanediol, 1,5-pentanediol, 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. Polyetheramines are based on polyetherpolyols in which the terminal hydroxyl group is replaced by amine groups. The polyetheramine backbone, in one aspect, may be based on polyalkylene oxide, for example, propylene oxide, ethylene oxide, or mixtures thereof. Other backbone segments may be included, or the reactivity of the polyetheramine may be varied by hindering the primary amine or through secondary amine functionality. Suitable polyetheramines include those commercially available from Huntsman Chemicals of Woodlands Tex. under the trade name Jeffamine® Suitable diamines, polyamines, or aminoalcohols include linear or branched or cyclic diamines, triamines, aminoalcohols, alkylene diamines, dialkylenetriamine and mixtures thereof. In one aspect, the diamine may be selected from the group consisting of 2-methylpentamethylenediamine, bishexamethylenetriamine, diaminocyclohexane, ethylenediamine, propylenedimine pentanediamine, hexamethylenediamine, isophoronediamine, piperazine, and combinations thereof. These may be sold under the trade name Dytek® (by Invista of Wilmington, Del.). Aminoalcohols include diamines with 2-12 carbon atoms which also have one or more hydroxyl groups in their structure.

Additional coupling agents, which may be useful in increasing the stability of the polymer dispersion in an aqueous environment, include difunctional reactants with hydroxyl or amine groups and one or more anionic, cationic, or amine group selected from the group consisting of $—COO^-$, $—SO_3^-$, $—OSO_3^-$, $—OPO_3^-$, $—N(R_5)_2$ or $—N^+(R_5)_3\ X^-$, and combinations thereof, wherein each $R_5$ is selected from the group consisting of hydrogen; $C_1$-$C_{20}$ alkyl, benzyl or their substituted derivatives, and combinations thereof, and wherein $X^-$ is any compatible anion.

The organosiloxane polymer may also contain a monofunctional chain-blocker (also referred to as a "capping group"). Monofunctional chain blockers, as used herein, are coupling agents containing a single group capable of reacting with an isocyanate group. The monofunctional chain blocker can be used to regulate the molecular weight of the polymer. Suitable chain blockers may include $C_2$-$C_4$ dialkylenetriamine and its derivatives, bis(2-dialkylaminoalkyl)ether; N,N dialkylethanolamine, Pentaalkyldiethylenetriamine; Pentaalkyldipropylenetriamine; N,N-dialkylcyclohexylamine, N,N,N'-trialkyl N' hydroxyalkylbis aminoethyl ether; N,N-bis(dialkylaminopropyl)-N-isopropylamine; and N,N,N'-trialkylaminoalkylethanolamine. In one aspect the polyamine may be selected from the group consisting of N,N-bis(3-dimethylaminopropyl)-N-isopropanolamine, bis(2 dimethylaminoethyl)ether, N,N-dimethylethanolamine, pentamethyl diethylenetriamine, N,N,N',N',N'-pentamethyldipropylenetriamine, N,N,N'-trimethyl-N'-hydroxyethyl bisaminoethylether, N,N-bis(3-dimethylaminopropyl), N-isopropanolamine, N-(3dimethylaminopropyl)-N,N-diisopropylamine, 1,3 propanediamine, N' (3-(dimethylamino)propyl)-N,N-dimethyl, N,N,N'-trimethylaminoethyl ethanolamine, and combinations thereof.

In one aspect, the organosiloxane polymer may be terminated with a monofunctional chain blocker to produce a structure:

Formula IV

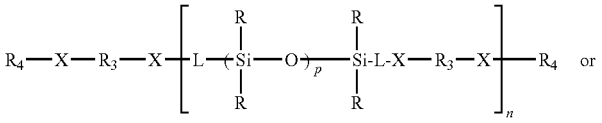

or

Formula V

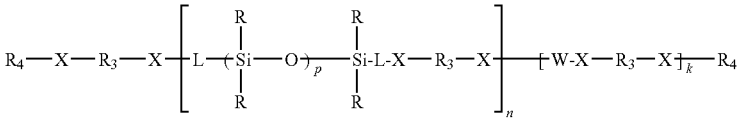

wherein, $R_4$ may be selected from the group consisting of $C_1$-$C_{20}$ alkyl, substituted alkyl group, and combinations thereof, wherein at least about 50% of the $R_4$ groups have one or more tertiary amino groups. R, $R_3$, X, L, n, W, and k are defined as above.

In one aspect, the weight average molecular weight of organosiloxane polymer may be from about 1000 to about 500,000 50,000 Daltons, or from about 2,000 Daltons to about 250,000 50,000 Daltons.

Surfactants

In a further aspect, the fabric care composition may comprise from about 0.01% to 80%, or about 1% to about 50%, or from about 10% to about 30% by weight of a surfactant. Suitable surfactants include anionic, nonionic, zwitterionic, ampholytic or cationic type surfactants, or mixtures thereof, such as those disclosed in, for example, U.S. Pat. No. 3,664,961, U.S. Pat. No. 3,919,678, U.S. Pat. No. 4,222,905, and U.S. Pat. No. 4,239,659. As will be readily understood in the art, anionic and nonionic surfactants are generally suitable if the fabric care product is a laundry detergent, while cationic surfactants are generally useful if the fabric care product is a fabric softener. Non-limiting examples of surfactants suitable for the disclosed compositions are listed herein.

Anionic Surfactants—Useful anionic surfactants can themselves be of several different types, for example, the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" may be the alkyl portion of aryl groups.) Examples of this group of synthetic surfactants are the alkyl sulfates and alkyl alkoxy sulfates, especially those obtained by sulfating the higher alcohols ($C_{8-18}$ carbon atoms). Other anionic surfactants useful with the compositions described herein are the water-soluble salts of: paraffin sulfonates containing from about 8 to about 24 (alternatively about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group. In another aspect, the anionic surfactant may be a $C_{11}$-$C_{18}$ alkyl benzene sulfonate surfactant; a $C_{10}$-$C_{20}$ alkyl sulfate surfactant; a $C_{10}$-$C_{18}$ alkyl alkoxy sulfate surfactant, having an average degree of alkoxylation of from 1 to 30, wherein the alkoxy may comprise a $C_1$ to $C_4$ chain or mixtures thereof; a mid-chain branched alkyl sulfate surfactant; a mid-chain branched alkyl alkoxy sulfate surfactant having an average degree of alkoxylation of from 1 to 30, wherein the alkoxy may comprise a $C_1$ to $C_4$ chain or mixtures thereof; a $C_{10}$-$C_{18}$ alkyl alkoxy carboxylates comprising an average degree of alkoxylation of from 1 to 5; a $C_{12}$-$C_{20}$ methyl ester sulfonate surfactant, a $C_{10}$-$C_{18}$ alpha-olefin sulfonate surfactant, a $C_6$-$C_{20}$ sulfosuccinate surfactant, and a mixture thereof.

Nonionic Surfactants—The compositions may contain up to about 30%, alternatively from about 0.01% to about 20%, or from about 0.1% to about 10%, by weight of the composition, of a nonionic surfactant. In one aspect, the nonionic surfactant may be an ethoxylated nonionic surfactant. Examples of suitable non-ionic surfactants are provided in U.S. Pat. No. 4,285,841. Suitable for use herein are the ethoxylated alcohols and ethoxylated alkyl phenols of the formula $R(OC_2H_4)_n$ OH, wherein R may be selected from the group consisting of aliphatic hydrocarbon radicals containing from about 8 to about 15 carbon atoms, alkyl phenyl radicals in which the alkyl groups contain from about 8 to about 12 carbon atoms, and combinations thereof, wherein the average value of n may be from about 5 to about 15. Suitable nonionic surfactants also include those of the formula $R^1(OC_2H_4)_n$OH, wherein $R^1$ may be a $C_{10}$-$C_{16}$ alkyl group or a $C_8$-$C_{12}$ alkyl phenyl group, and n may be from 3 to 80. In one aspect, condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol are used.

Cationic Surfactants—The compositions may contain up to about 40%, from about 0.01% to about 20%, or from about 0.1% to about 20%, by weight of the composition, of a cationic surfactant. Cationic surfactants include those which can deliver fabric care benefits. Non-limiting examples of useful cationic surfactants include fatty amines; quaternary ammonium surfactants; and imidazoline compounds. In one aspect, the cationic surfactant may be a cationic softening compound such as a quaternary ammonium compound. In one aspect, the quaternary ammonium compound may be an ester quaternary ammonium compound, an alkyl quaternary ammonium compound, or mixtures thereof. In yet another aspect, the ester quaternary ammonium compound may be a mixture of mono- and di-ester quaternary ammonium compound. Those skilled in the art will recognize that cationic softening compounds can be selected from mono-, di-, and tri-esters, as well as other cationic softening compounds, and mixtures thereof, depending on the process and the starting materials. Suitable fabric softening compounds are disclosed in USPA 2004/0204337. The cationic surfactant may be an ester quaternary ammonium compound (DEQA), and may include diamido fabric softener actives as well as fabric softener actives with mixed amido and ester linkages. Additional suitable DEQA active include those described in U.S. Pat. No. 4,137,180. Additional cationic surfactants useful as fabric softening actives include acyclic quaternary ammonium salts such as those described in USPA 2005/0164905; pentaerythritol compounds disclosed in U.S. Pat. Nos. 6,492,322, 6,194,374, 5,358,647, 5,332,513, 5,290,459, 5,750,990, 5,830,845, 5,460,736, 5,126,060, and USPA 2004/0204337. An example of an ester quaternary ammonium compound includes bis-(2-hydroxyethyl)-dimethylammonium chloride fatty acid ester having an average chain length of the fatty acid moieties of from 16 to 18 carbon atoms, and an Iodine Value (IV), calculated for the free fatty acid, from 0 to 50, alternatively from 18 to 22. The Iodine Value is the amount of iodine in grams consumed by the reaction of the double bonds of 100 g of fatty acid, determined by the method of ISO 3961.

Materials Containing an Aldehyde and/or Ketone Groups

In a further aspect, the fabric care composition may comprise from about 0.0001% to about 2%, or from about 0.001% to about 1%, by weight of the composition of at least one material comprising an aldehyde and/or ketone group.

Suitable materials comprising an aldehyde and/or ketone group include biocontrol ingredients such as biocides, antimicrobials, bactericides, fungicides, algaecides, mildewcides, disinfectants, antiseptics, insecticides, vermicides, plant growth hormones. Suitable antimicrobials include chlorhexidine diacetate, glutaraldehyde, cinnamon oil and cinnamaldehyde, polybiguanide, eugenol, thymol, geraniol, or mixtures thereof.

In one aspect, the material comprising an aldehyde and/or ketone group may be a perfume ingredient. These may include, for example, one or more perfume ingredients listed in Table I.

TABLE I

Exemplary Perfume Ingredients

| Number | IUPAC Name | Trade Name | Functional Group |
|---|---|---|---|
| 1 | Benzaldehyde | Benzaldehyde | Aldehyde |
| 2 | 6-Octenal, 3,7-dimethyl- | Citronellal | Aldehyde |
| 3 | Octanal, 7-hydroxy-3,7-dimethyl- | Hydroxycitronellal | Aldehyde |
| 4 | 3-(4-tert-butylphenyl)butanal | Lilial | Aldehyde |
| 5 | 2,6-Octadienal, 3,7-dimethyl- | Citral | Aldehyde |
| 6 | Benzaldehyde, 4-hydroxy-3-methoxy- | Vanillin | Aldehyde |
| 7 | 2-(phenylmethylidene)octanal | Hexyl Cinnamic Aldehyde | Aldehyde |
| 8 | 2-(phenylmethylidene)heptanal | Amyl Cinnamic Aldehyde | Aldehyde |
| 9 | 3-Cyclohexene-1-carboxaldehyde, dimethyl- | Ligustral, | Aldehyde |
| 10 | 3-Cyclohexene-1-carboxaldehyde, 3,5-dimethyl- | Cyclal C | Aldehyde |
| 11 | Benzaldehyde, 4-methoxy- | Anisic Aldehyde | Aldehyde |
| 12 | 2-Propenal, 3-phenyl- | Cinnamic Aldehyde | Aldehyde |
| 13 | 5-Heptenal, 2,6-dimethyl- | Melonal | Aldehyde |

TABLE I-continued

| Exemplary Perfume Ingredients | | | |
|---|---|---|---|
| Number | IUPAC Name | Trade Name | Functional Group |
| 14 | Benzenepropanal, 4-(1,1-dimethylethyl)- | Bourgeonal | Aldehyde |
| 15 | Benzenepropanal, .alpha.-methyl-4-(1-methylethyl)- | Cymal | Aldehyde |
| 16 | Benzenepropanal, .beta.-methyl-3-(1-methylethyl)- | Florhydral | Aldehyde |
| 17 | Dodecanal | Lauric Aldehyde | Aldehyde |
| 18 | Undecanal, 2-methyl- | Methyl Nonyl Acetaldehyde | Aldehyde |
| 19 | 10-Undecenal | Intreleven Aldehyde Sp | Aldehyde |
| 20 | Decanal | Decyl Aldehyde | Aldehyde |
| 21 | Nonanal | Nonyl Aldehyde | Aldehyde |
| 22 | Octanal | Octyl Aldehyde | Aldehyde |
| 23 | Undecenal | Iso C-11 Aldehyde | Aldehyde |
| 24 | Decanal, 2-methyl- | Methyl Octyl Acetaldehyde | Aldehyde |
| 25 | Undecanal | Undecyl Aldehyde | Aldehyde |
| 26 | 2-Undecenal | 2-Undecene-1-Al | Aldehyde |
| 27 | 2,6-Octadiene, 1,1-diethoxy-3,7-dimethyl- | Citrathal | Aldehyde |
| 28 | 3-Cyclohexene-1-carboxaldehyde, 1-methyl-4-(4-methylpentyl)- | Vernaldehyde | Aldehyde |
| 29 | Benzenepropanal, 4-methoxy-.alpha.-methyl- | Canthoxal | Aldehyde |
| 30 | 9-Undecenal, 2,6,10-trimethyl- | Adoxal | Aldehyde |
| 31 | Acetaldehyde, [(3,7-dimethyl-6-octenyl)oxy]- | Citronellyl Oxyacetaldehyde | Aldehyde |
| 32 | Benzeneacetaldehyde | Phenyl Acetaldehyde | Aldehyde |
| 33 | Benzeneacetaldehyde, .alpha.-methyl- | Hydratropic Aldehyde | Aldehyde |
| 34 | Benzenepropanal, .beta.-methyl- | Trifernal | Aldehyde |
| 35 | 2-Buten-1-one, 1-(2,6,6-trimethyl-3-cyclohexen-1-yl)- | Delta Damascone | Ketone |
| 36 | 2-Buten-1-one, 1-(2,6,6-trimethyl-2-cyclohexen-1-yl)- | Alpha Damascone | Ketone |
| 37 | 2-Buten-1-one, 1-(2,6,6-trimethyl-1-cyclohexen-1-yl)-, (Z)- | Damascone Beta | Ketone |
| 38 | 2-Buten-1-one, 1-(2,6,6-trimethyl-1,3-cyclohexadien-1-yl)- | Damascenone | Ketone |
| 39 | (E)-1-(2,4,4-trimethylcyclohex-2-en-1-yl)but-2-en-1-one | Iso-Damascone | Ketone |
| 40 | 3-Buten-2-one, 3-methyl-4-(2,6,6-trimethyl-2-cyclohexen-1-yl)- | Ionone Gamma Methyl | Ketone |
| 41 | 3-Buten-2-one, 4-(2,6,6-trimethyl-2-cyclohexen-1-yl)-, (E)- | Inone Alpha | Ketone |
| 42 | 3-Buten-2-one, 4-(2,6,6-trimethyl-1-cyclohexen-1-yl)- | Ionone Beta | Ketone |
| 43 | 1-naphthalen-2-ylethanone | Methyl beta naphthyl ketone | Ketone |
| 44 | methyl 3-oxo-2-pentylcyclopentaneacetate | Methyl-Dihydrojasmonate | Ketone |
| 45 | 1-(5,5-dimethyl-1-cyclohexenyl)pent-4-en-1-one | Neobutenone | Ketone |
| 46 | 1-(2,3,8,8-tetramethyl-1,3,4,5,6,7-hexahydronaphthalen-2-yl)ethanone | Iso-E-Super | Ketone |
| 47 | 4-(4-hydroxyphenyl)butan-2-one | Para-Hydroxy-Phenyl-Butanone | Ketone |
| 48 | | Methyl cedrylone | Ketone |
| 49 | 2-Cyclohexen-1-one, 2-methyl-5-(1-methylethenyl)-, (R)- | Laevo Carvone | Ketone |
| 50 | (2R,5S)-5-methyl-2-propan-2-ylcyclohexan-1-one | Menthone | Ketone |
| 51 | 1,7,7-trimethylbicyclo[2.2.1]heptan-2-one | Camphor | Ketone |
| 52 | 2-hexylcyclopent-2-en-1-one | iso jasmone; | Ketone |

Adjuncts Ingredients

The disclosed compositions may include additional adjunct ingredients. The following is a non-limiting list of suitable additional adjuncts.

Fatty Acids—The compositions may optionally contain from about 0.01% to about 10%, or from about 2% to about 7%, or from about 3% to about 5%, by weight the composition, of a fatty acid, wherein, in one aspect, the fatty acid may comprise from about 8 to about 20 carbon atoms. The fatty acid may comprise from about 1 to about 10 ethylene oxide units in the hydrocarbon chain. Suitable fatty acids may be saturated and/or unsaturated and can be obtained from natural sources such a plant or animal esters (e.g., palm kernel oil, palm oil, coconut oil, babassu oil, safflower oil, tall oil, castor oil, tallow and fish oils, grease, or mixtures thereof), or synthetically prepared (e.g., via the oxidation of petroleum or by hydrogenation of carbon monoxide via the Fisher Tropsch process). Examples of suitable saturated fatty acids for use in the compositions include capric, lauric, myristic, palmitic, stearic, arachidic and behenic acid. Suitable unsaturated fatty acid species include: palmitoleic, oleic, linoleic, linolenic and ricinoleic acid. Examples of fatty acids are saturated C12 fatty acid, saturated C12-C14 fatty acids, and saturated or unsaturated C12 to C18 fatty acids, and mixtures thereof.

Builders—The compositions may also contain from about 0.1% to 80% by weight of a builder. Compositions in liquid form generally contain from about 1% to 10% by weight of the builder component. Compositions in granular form generally contain from about 1% to 50% by weight of the builder component. Detergent builders are well known in the art and can contain, for example, phosphate salts as well as various organic and inorganic nonphosphorus builders. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid. Other suitable polycarboxylates for use herein are the polyacetal carboxylates described in U.S. Pat. No. 4,144,226 and U.S. Pat. No. 4,246,495. Other polycarboxylate builders are the oxydisuccinates and the ether carboxylate builder compositions comprising a combination of tartrate monosuccinate and tartrate disuccinate described in U.S. Pat. No. 4,663,071, Builders for use in liquid detergents are described in U.S. Pat. No. 4,284,532, One suitable builder includes may be citric acid. Suitable nonphosphorus, inorganic builders include the silicates, aluminosilicates, borates and carbonates, such as sodium and potassium carbonate, bicarbonate, sesquicarbonate, tetraborate decahydrate, and silicates having a weight ratio of SiO2 to alkali metal oxide of from about 0.5 to about 4.0, or from about 1.0 to about 2.4. Also useful are aluminosilicates including zeolites. Such materials and their use as detergent builders are more fully discussed in U.S. Pat. No. 4,605,509.

Dispersants—The compositions may contain from about 0.1%, to about 10%, by weight of dispersants Suitable water-soluble organic materials are the homo- or co-polymeric acids or their salts, in which the polycarboxylic acid may contain at least two carboxyl radicals separated from each other by not more than two carbon atoms. The dispersants may also be alkoxylated derivatives of polyamines, and/or quaternized derivatives thereof such as those described in U.S. Pat. Nos. 4,597,898, 4,676,921, 4,891,160, 4,659,802 and 4,661,288.

Enzymes—The compositions may contain one or more detergent enzymes which provide cleaning performance and/or fabric care benefits. Examples of suitable enzymes include hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination may be a cocktail of conventional applicable enzymes like protease, lipase, cutinase and/or cellulase in conjunction with amylase. Enzymes can be used at their art-taught levels, for example at levels recommended by suppliers such as Novozymes and Genencor. Typical levels in the compositions are from about 0.0001% to about 5%. When enzymes are present, they can be used at very low levels, e.g., from about 0.001% or lower; or they can be used in heavier-duty laundry detergent formulations at higher levels, e.g., about 0.1% and higher. In accordance with a preference of some consumers for "non-biological" detergents, the compositions may be either or both enzyme-containing and enzyme-free.

Stabilizer—The compositions may contain one or more stabilizers and thickeners. Any suitable level of stabilizer may be of use; exemplary levels include from about 0.01% to about 20%, from about 0.1% to about 10%, or from about 0.1% to about 3% by weight of the composition. Non-limiting examples of stabilizers suitable for use herein include crystalline, hydroxyl-containing stabilizing agents, trihydroxystearin, hydrogenated oil, or a variation thereof, and combinations thereof. In some aspects, the crystalline, hydroxyl-containing stabilizing agents may be water-insoluble wax-like substances, including fatty acid, fatty ester or fatty soap. In other aspects, the crystalline, hydroxyl-containing stabilizing agents may be derivatives of castor oil, such as hydrogenated castor oil derivatives, for example, castor wax. The hydroxyl containing stabilizers are disclosed in U.S. Pat. Nos. 6,855,680 and 7,294,611. Other stabilizers include thickening stabilizers such as gums and other similar polysaccharides, for example gellan gum, carrageenan gum, and other known types of thickeners and rheological additives. Exemplary stabilizers in this class include gum-type polymers (e.g. xanthan gum), polyvinyl alcohol and derivatives thereof, cellulose and derivatives thereof including cellulose ethers and cellulose esters and tamarind gum (for example, comprising xyloglucan polymers), guar gum, locust bean gum (in some aspects comprising galactomannan polymers), and other industrial gums and polymers.

Dye Transfer Inhibiting Agents—The compositions may also include from about 0.0001%, from about 0.01%, from about 0.05% by weight of the compositions to about 10%, about 2%, or even about 1% by weight of the compositions of one or more dye transfer inhibiting agents such as polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Chelant—The compositions may contain less than about 5%, or from about 0.01% to about 3% of a chelant such as citrates; nitrogen-containing, P-free aminocarboxylates such as EDDS, EDTA and DTPA; aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelants such as compounds of the general class of certain macrocyclic N-ligands such as those known for use in bleach catalyst systems.

Brighteners—The compositions may also comprise a brightener (also referred to as "optical brightener") and may include any compound that exhibits fluorescence, including compounds that absorb UV light and reemit as "blue" visible light. Non-limiting examples of useful brighteners include: derivatives of stilbene or 4,4'-diaminostilbene, biphenyl, five-membered heterocycles such as triazoles, pyrazolines, oxazoles, imidiazoles, etc., or six-membered heterocycles (coumarins, naphthalamide, s-triazine, etc.). Cationic, anionic, nonionic, amphoteric and zwitterionic brighteners can be used. Suitable brighteners include those commercially marketed under the trade name Tinopal-UNPA-GX® by Ciba Specialty Chemicals Corporation (High Point, N.C.).

Bleach system—Bleach systems suitable for use herein contain one or more bleaching agents. Non-limiting examples of suitable bleaching agents include catalytic metal complexes; activated peroxygen sources; bleach activators; bleach boosters; photobleaches; bleaching enzymes; free radical initiators; H2O2; hypohalite bleaches; peroxygen sources, including perborate and/or percarbonate and combinations thereof. Suitable bleach activators include perhydrolyzable esters and perhydrolyzable imides such as, tetraacetyl ethylene diamine, octanoylcaprolactam, benzoyloxybenzenesulphonate, nonanoyloxybenzene¬isulphonate, benzoylvalerolactam, dodecanoyloxybenzenesulphonate. Suitable bleach boosters include those described in U.S. Pat. No. 5,817,614. Other bleaching agents include metal complexes of transitional metals with ligands of defined stability constants. Such catalysts are disclosed in U.S. Pat. Nos. 4,430,243, 5,576,282, 5,597,936 and 5,595,967.

Delivery Enhancing Agents—The compositions may comprise from about 0.01% to about 10% of the composition of a "delivery enhancing agent." As used herein, such term refers to any polymer or combination of polymers that significantly enhance the deposition of the fabric care benefit agent onto the fabric during laundering. Preferably, delivery enhancing agent may be a cationic or amphoteric polymer. The cationic charge density of the polymer ranges from about 0.05 milliequivalents/g to about 23 milliequivalents/g. The charge density may be calculated by dividing the number of net charge per repeating unit by the molecular weight of the repeating unit. In one aspect, the charge density varies from about 0.05 milliequivalents/g to about 8 milliequivalents/g. The positive charges could be on the backbone of the polymers or the side chains of polymers. For polymers with amine monomers, the charge density depends on the pH of the carrier. For these polymers, charge density may be measured at a pH of 7. Non-limiting examples of deposition enhancing agents are cationic or amphoteric, polysaccharides, proteins and synthetic polymers. Cationic polysaccharides include cationic cellulose derivatives, cationic guar gum derivatives, chitosan and derivatives and cationic starches. Cationic polysaccharides have a molecular weight from about 50,000 to about 2 million, preferably from about 100,000 to about 1,500,000. Suitable cationic polysaccharides include cationic cellulose ethers, particularly cationic hydroxyethylcellulose and cationic hydroxypropylcellulose. Examples of cationic hydroxyalkyl cellulose include those with the INCI name Polyquaternium10 such as those sold under the trade names Ucare Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name Celquat H200 and Celquat L-200 available from National Starch and Chemical Company, Bridgewater, N.J. Other suitable polysaccharides include Hydroxyethyl cellulose or hydroxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J. Cationic starches described by D. B. Solarek in Modified Starches, Properties and Uses published by CRC Press (1986) and in U.S. Pat. No. 7,135,451, col. 2, line 33-col. 4, line 67. Cationic galactomannans include cationic guar gums or cationic locust bean gum. An example of a cationic guar gum is a quaternary ammonium derivative of Hydroxypropyl Guar such as those sold under the trade name Jaguar C13 and Jaguar Excel available from Rhodia, Inc of Cranbury N.J. and N-Hance by Aqualon, Wilmington, Del.

In one aspect, a synthetic cationic polymer may be used as the delivery enhancing agent. The molecular weight of these polymers may be in the range of from about 2000 to about 5 million kD. Synthetic polymers include synthetic addition polymers of the general structure

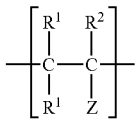

wherein each $R^1$ may be independently hydrogen, $C_1$-$C_{12}$ alkyl, substituted or unsubstituted phenyl, substituted or unsubstituted benzyl, —$OR_a$, or —$C(O)OR_a$ wherein $R_a$ may be selected from the group consisting of hydrogen, $C_1$-$C_{24}$ alkyl, and combinations thereof. In one aspect, $R^1$ may be hydrogen, $C_1$-$C_4$ alkyl, or —$OR_{hd\ a}$, or —$C(O)OR_a$ wherein each $R^2$ may be independently selected from the group consisting of hydrogen, hydroxyl, halogen, $C_1$-$C_{12}$ alkyl, —$OR_a$, substituted or unsubstituted phenyl, substituted or unsubstituted benzyl, carbocyclic, heterocyclic, and combinations thereof. In one aspect, $R^2$ may be selected from the group consisting of hydrogen, $C_1$-$C_4$ alkyl, and combinations thereof.

Each Z may be independently hydrogen, halogen; linear or branched $C_1$-$C_{30}$ alkyl, nitrilo, $N(R_3)_2$—$C(O)N(R_3)_2$; —NHCHO (formamide); —$OR^3$, —$O(CH_2)_nN(R^3)_2$, —$O(CH_2)_nN^+(R^3)_3X^-$, —$C(O)OR^4$; —$C(O)N(R^3)_2$, —$C(O)O(CH_2)_nN(R^3)_2$, —$C(O)O(CH_2)_nN^+(R^3)_3X^-$, —$OCO(CH_2)_nN(R^3)_2$, —$OCO(CH_2)_nN^+(R^3)_3X^-$, —$C(O)NH$—$(CH_2)_nN(R^3)_2$, —$C(O)NH(CH_2)_nN^+(R^3)_3X^-$, —$(CH_2)_nN(R^3)_2$, —$(CH_2)_aN^+(R^3)_3X^-$, Each $R_3$ may be independently selected from the group consisting of hydrogen, $C_1$-$C_{24}$ alkyl, $C_2$-$C_8$ hydroxyalkyl, benzyl, substituted benzyl, and combinations thereof;

Each $R_4$ may be independently selected from the group consisting of hydrogen, $C_1$-$C_{24}$ alkyl,

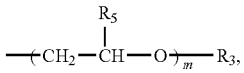

and combinations thereof.

X may be a water soluble anion wherein n may be from about 1 to about 6.

$R_5$ may be independently selected from the group consisting of hydrogen, $C_1$-$C_6$ alkyl, and combinations thereof.

Z may also be selected from the group consisting of non-aromatic nitrogen heterocycles containing a quaternary ammonium ion, heterocycles containing an N-oxide moiety, aromatic nitrogens containing heterocyclic wherein one or more or the nitrogen atoms may be quaternized; aromatic nitrogen-containing heterocycles wherein at least one nitrogen may be an N-oxide; and combinations thereof. Non-limiting examples of addition polymerizing monomers comprising a heterocyclic Z unit includes 1-vinyl-2-pyrrolidinone, 1-vinylimidazole, quaternized vinyl imidazole, 2-vinyl-1,3-dioxolane, 4-vinyl-1-cyclohexene-1, 2-epoxide, and 2-vinylpyridine, 2-vinylpyridine N-oxide, 4-vinylpyridine 4-vinylpyridine N-oxide.

A non-limiting example of a Z unit which can be made to form a cationic charge in situ may be the —NHCHO unit, formamide. The formulator can prepare a polymer or copolymer comprising formamide units some of which are subsequently hydrolyzed to form vinyl amine equivalents.

The polymers or co-polymers may also contain one or more cyclic polymer units derived from cyclically polymerizing monomers. An example of a cyclically polymerizing monomer is dimethyl diallyl ammonium having the formula:

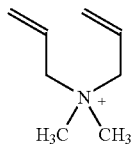

Suitable copolymers may be made from one or more cationic monomers selected from the group consisting of N,N-dialkylaminoalkyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl acrylate, quaternized N,N-dialkylaminoalkyl acrylamide, quaternized N,N-dialkylaminoalkylmethacrylamide, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole and derivatives, acrylic acid, methacrylic acid, maleic acid, vinyl sulfonic acid, styrene sulfonic acid, acrylamidopropylmethane sulfonic acid (AMPS) and their salts, and combinations thereof. The polymer may optionally be cross-linked. Suitable crosslinking monomers include ethylene glycoldiacrylate, divinylbenzene, butadiene.

In one aspect, the synthetic polymers are poly(acrylamide-co-diallyldimethylammonium chloride), poly(acrylamide-methacrylamidopropyltrimethyl ammonium chloride), poly (acrylamide-co-N,N-dimethyl aminoethyl methacrylate), poly(acrylamide-co-N,N-dimethyl aminoethyl acrylate), poly(hydroxyethylacrylate-co-dimethyl aminoethyl methacrylate), poly(hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid). Examples of other suitable synthetic polymers are Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33.

Other cationic polymers include polyethyleneamine and its derivatives and polyamidoamine-epichlorohydrin (PAE) Resins. In one aspect, the polyethylene derivative may be an amide derivative of polyetheylenimine sold under the trade name Lupasol SK. Also included are alkoxylated polyethlenimine; alkyl polyethyleneimine and quaternized polyethyleneimine. These polymers are described in Wet Strength resins and their applications edited by L. L. Chan, TAPPI Press (1994). The weight-average molecular weight of the polymer will generally be from about 10,000 to about 5,000,000, or from about 100,000 to about 200,000, or from about 200,000 to about 1,500,000 Daltons, as determined by size exclusion chromatography relative to polyethylene oxide standards with RI detection. The mobile phase used is a solution of 20% methanol in 0.4M MEA, 0.1 M $NaNO_3$, 3% acetic acid on a Waters Linear Ultrandyrogel column, 2 in series. Columns and detectors are kept at 40° C. Flow is set to 0.5 mL/min.

In another aspect, the deposition aid may comprise poly (acrylamide-N-dimethyl aminoethyl acrylate) and its quaternized derivatives. In this aspect, the deposition aid may be that sold under the tradename Sedipur®, available from BTC Specialty Chemicals, a BASF Group, Florham Park, N.J. In one embodiment, the deposition aid is cationic acrylic based homopolymer sold under the tradename name Rheovis CDE, from CIBA. See also US 2006/0094639; U.S. Pat. No. 7,687,451; U.S. Pat. No. 7,452,854.

Carrier—The compositions generally contain a carrier. Suitable carriers may include any suitable composition in which it is possible to produce organosilicone microemulsions having an average particle size of about 0.1 μm or less. In some aspects, the carrier may be water alone or mixtures of organic solvents with water. In some aspects, organic solvents include 1,2-propanediol, ethanol, glycerol and mixtures thereof. Other lower alcohols, C1-C4 alkanolamines such as monoethanolamine and triethanolamine, can also be used. Carriers can be absent, for example, in anhydrous solid forms of the composition, but more typically are present at levels in the range of from about 0.1% to about 98%, from about 10% to about 95%, or from about 25% to about 75%.

Perfume Microcapsules—The composition of the present invention further comprises a perfume microcapsule. Suitable perfume microcapsules may include those described in the following references: US 2003-215417 A1; US 2003-216488 A1; US 2003-158344 A1; US 2003-165692 A1; US 2004-071742 A1; US 2004-071746 A1; US 2004-072719 A1; US 2004-072720 A1; EP 1393706 A1; US 2003-203829 A1; US 2003-195133 A1; US 2004-087477 A1; US 2004-0106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; U.S. RE 32713; U.S. Pat. No. 4,234,627. In another embodiment, the perfume microcapsule comprises a friable microcapsule (e.g., aminoplast copolymer comprising perfume microcapsule, esp. melamine-formaldehyde or urea-formaldehyde). In another embodiment, the perfume microcapsule comprises a moisture-activated microcapsule (e.g., cyclodextrin comprising perfume microcapsule). In another embodiment, the perfume microcapsule may be coated with a polymer (alternatively a charged polymer)

Other adjuncts—Examples of other suitable adjunct materials include alkoxylated benzoic acids or salts thereof such as trimethoxy benzoic acid or a salt thereof (TMBA); zwitterionic and/or amphoteric surfactants; enzyme stabilizing systems; coating or encapsulating agent including polyvinylalcohol film or other suitable variations, carboxymethylcellulose, cellulose derivatives, starch, modified starch, sugars, PEG, waxes, or combinations thereof; soil release polymers; dispersants; suds suppressors; dyes; colorants; filler salts such as sodium sulfate; hydrotropes such as toluenesulfonates, cumenesulfonates and naphthalenesulfonates; photoactivators; hydrolyzable surfactants; preservatives; anti-oxidants; anti-shrinkage agents; other anti-wrinkle agents; germicides; fungicides; color speckles; colored beads, spheres or extrudates; sunscreens; fluorinated compounds; clays; pearlescent agents; luminescent agents or chemiluminescent agents; anti-corrosion and/or appliance protectant agents; alkalinity sources or other pH adjusting agents; solubilizing agents; processing aids; pigments; free radical scavengers, and combinations thereof. Suitable materials include those disclosed in U.S. Pat. Nos. 5,705,464, 5,710,115, 5,698,504, 5,695,679, 5,686,014 and 5,646,101.

Methods of Using

The instant disclosure further relates to methods of using the fabric care compositions disclosed herein. In one aspect, the disclosure relates to a method of providing a benefit to a fabric comprising contacting the step of contacting a fabric with the fabric care composition comprising an organosiloxane polymer of the instant disclosure, at least one surfactant, and at least one material comprising an aldehyde and/or ketone group. In one aspect, the benefit to the fabric may be a wrinkle benefit. In other aspects, the benefit includes other care benefits such as softening, color care, color protection, anti-dye transfer, pilling or fuzz control, anti-static, and shape maintenance.

In a further aspect, the method relates to contacting a fabric with the fabric care composition in a rinse solution. In a yet further aspect, the method relates to contacting a fabric with the fabric care composition in a wash solution. The method further relates to contacting the fabric care composition with a fabric using a spray or immersion application, wherein the fabric may be wet or dry prior to contact with the fabric care composition. The method further relates to contacting a fabric with the fabric care composition before, during, or after a drying step.

Three Dimension Fabric Feel Benefits

This method describes the objective and quantitative measurement of tactile feel characteristics imparted by chemistries deposited onto fabric surfaces. The measurement protocols described measure the effect of deposited chemical treatments on the Friction, Bending and Compression of fabric within a three dimensional parameter space which uniquely defines the tactile feel imparted by the chemical treatment.

Fabric Cloths

The fabric to be used is a 100% ring spun cotton, white terry (warp pile weave) towel wash cloth of Eurotouch brand, product number 63491624859, manufactured by Standard Textile (Standard Textile Company, Cincinnati Ohio). Each fabric cloth is approximately 33 cm×33 cm, and weighs approximately 680 g per 12 cloths, and has pile nominal loop sizes of 10-12 mm. If this particular fabric is unavailable when requested, then a brand of new terry fabric which meets the same physical specifications listed, and has the warp & weft weave directions clearly identified, may be used as a substitute.

Fabric Cloth Desizing—Preparation Prior to Treatment

The following desizing procedure is used to prepare the fabric cloths prior to their use in deposition testing. Fabrics are desized in a residential top-loading washing, with 35 fabric cloths per load, using reverse osmosis water at 49° C., and 64.35 L of water per fill. Each load is washed for at least 5 complete normal wash-rinse-spin cycles. The desizing step consists of two normal cycles with detergent added at the beginning of each cycle, followed by 3 more cycles with no detergent added. The detergent used is the 2003 AATCC Standard Reference Liquid Detergent (American Association of Textile Chemists and Colorists) at 119 g of per cycle for the 64.35 L. If suds are still present after the third no-detergent-added cycle, as determined by the presence of visible bubbles on the surface of the rinse water prior to the spin step, then continue with additional no-detergent added cycles until no suds are visible. The fabric cloths are then dried in a residential-grade electric-heated tumble dryer on highest heat setting until thoroughly dry, approximately 55 minutes.

After the fabric cloths are removed from the dryer, they are weighed to 0.01 g accuracy, and grouped by weight such that within each grouping there is ≦1 g variation in weight. On each day of measuring, ten or more replicate polydimethylsiloxane (PDMS) control-treatment samples must be run along with the 10 or more replicate test-treatments samples, and all fabric cloths used per day of measuring must be of equal weight to within 1 g (dry weight prior to treatments). For example, fabric cloths within the weight range of 59.00 g and 59.99 g would be grouped together. The treated fabrics are laid flat during storage and are used within a week of coating with treatment.

Preparation of Test Materials

Test materials which are miscible in water are to be prepared for testing by being made into a simple solution of at least 0.1% test material concentration (wt/wt), in deionised water (i.e., not a complex formulation), without the presence of visible precipitates or other phase-separated material for at least 48 hrs at room temperature.

Those test materials which are not miscible in water and the PDMS control-treatment used as aqueous emulsions. Preparation of silicone emulsions is well known to a person skilled in the art. See for example U.S. Pat. No. 7,683,119 and U.S. Patent Application 2007/0203263A1. Those skilled in the art will also understand that such emulsions can be produced using a variety of different surfactants or emulsifiers, depending upon the characteristics of each specific material. These emulsifiers can be selected from anionic, cationic, nonionic, zwitterionic or amphoteric surfactants. Preferred surfactants are listed in U.S. Pat. No. 7,683,119.

In one embodiment, the emulsifier is a nonionic surfactant selected from polyoxyalkylene alkyl ethers, polyoxyalkylene alkyl phenol ethers, alkyl polyglucosides, polyvinyl alcohol and glucose amide surfactant. Particularly preferred are secondary alkyl polyoxyalkylene alkyl ethers. Examples of such emulsifiers are C11-15 secondary alkyl ethoxylate such as those sold under the trade name Tergitol 15-S-5, Terigtol 15-S-12 by Dow Chemical Company of Midland Mich. or Lutensol XL-100 and Lutensol XL-50 by BASF, AG of Ludwigschaefen, Germany. Examples of branched polyoxyalkylene alkyl ethers include those with one or more branches on the alkyl chain such as those available from Dow Chemicals of Midland, Mich. under the trade name Tergitol TMN-10 and Tergiotol TMN-3.

In one embodiment cationic surfactants include quaternary ammonium salts such as alkyl trimethyl ammonium salts, and dialkyl dimethyl ammonium salts. In another embodiment, the surfactant is a quaternary ammonium compound. Preferably, the quaternary ammonium compound is a hydrocarbyl quaternary ammonium compound of formula (II):

Formula (II)

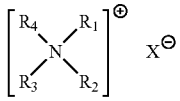

wherein R1 comprises a C12 to C22 hydrocarbyl chain, wherein R2 comprises a C6 to C12 hydrocarbyl chain, wherein R1 has at least two more carbon atoms in the hydrocarbyl chain than R2, wherein R3 and R4 are individually selected from the group consisting of C1-C4 hydrocarbyl, C1-C4 hydroxy hydrocarbyl, benzyl, —(C2H4O)xH where x has a value from about 1 to about 10, and mixtures thereof, and X— is a suitable charge balancing counter ion, in one aspect X— is selected from the group consisting of Cl—, Br—,I—, methyl sulfate, toluene, sulfonate, carboxylate and phosphate or a polyalkoxy quaternary ammonium compound of Formula (III)

Formula (III)

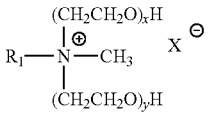

wherein x and y are each independently selected from 1 to 20, and wherein R1 is C6 to C22 alkyl, preferably wherein the aqueous surfactant mixture comprises a surfactant/polyorganosiloxane weight ratio of from about 1:1 to about 1:10 and X— is a suitable charge balancing counter ion, in one aspect X— is selected from the group consisting of Cl—, Br—, I—, methyl sulfate, toluene, sulfonate, carboxylate and phosphate.

Those skilled in the art will understand that such suspensions can be made by mixing the components together using a variety of mixing devices. Examples of suitable overhead mixers include: IKA Labortechnik, and Janke & Kunkel IKA WERK, equipped with impeller blade Divtech Equipment R1342. It is important that each test sample suspension has a volume-weighted, mode particle size of <1,000 nm and preferably >200 nm, as measured >12 hrs after emulsification, and <12 hrs prior to its use in the testing protocol. Particle size distribution is measured using a static laser diffraction instrument, operated in accordance with the manufactures instructions. Examples of suitable particle sizing instruments include: Horiba Laser Scattering Particle Size and Distributer Analyzer LA-930 and Malvern Mastersizer.

The PDMS control-treatment used in the control treatment is a polydimethylsiloxane emulsion made with a polydimethyl siloxane of 350 centistroke viscosity emulsified with a nonionic surfactant to achieve a target particle size of about 200 nm to about 800 nm. A non-limiting example is that available under the trade name DC 349 from Dow Corning Corporation, Midland, Mich. The PDMS control-treatment and test materials which are non-miscible in water are to be prepared for testing by being made into a simple emulsion of at least 0.1% active test material concentration (wt/wt), in deionised water, with a particle size distribution which is stable for at least 48 hrs at room temperature.

Treatment—Coating Fabrics with Emulsion Test Samples:

Forced-deposition is used to treat the desized fabric cloths with a coating of the treatment sample, at a dose of 1 mg of treatment material/g fabric (active wt/dry wt.). At least ten desized fabric cloth replicates are to be treated and measured for each different treatment chemistry being tested on each day of measurements, and for the PDMS control-treatment which is also included on each day of measurements.

Attain a 0.1% concentration (wt/wt) of the test material in the treatment sample, using deionized water to dilute if necessary. Weigh out an amount of this 0.1% treatment sample such that it has the same weight as the dry weight of the fabric cloth being treated (within 1 g), and pour that treatment sample into a glass cake pan large approximately 33 cm×38 cm in size. Rinse the container used to measure out the treatment sample with an equal amount of deionized water and add this rinse water to the same pan. Agitate the pan until the solution appears to be homogenously mixed. Lay a single fabric cloth flat into the pan and treatment fluid, with the label/tag side facing downward. Fabric edges which do not fit into the pan should be folded inwards toward the center of the fabric cloth. Distribute the fluid evenly onto the fabric cloth by bunching up the fabric up with two hands and squeezing. Use the fabric to soak up all excess fluid in the pan. The pans used for coating fabric should be cleaned thoroughly with alcohol wipes and allowed to dry between uses with different treatment chemistries. Treated fabrics are laid flat onto a new sheet of aluminum foil until all replicates for that treatment are completed. These replicate fabrics are then tumble dried together, and may require the addition of clean, untreated, desized fabric to act as a ballast to ensure proper tumbling. Tumble dry treated fabrics in a residential-grade electric-heated tumble dryer on highest heat setting for approximately 55 minutes. Replicate fabrics of each test treatment chemistry and in the PDMS control-treatment should be dried in separate dryer loads, to prevent cross-contamination between different treatment chemistries.

Conditioning/Equilibration:

When drying is completed, the treated fabric cloths are equilibrated for a minimum of 8 hours at 23° C. and 50% Relative Humidity. Treated and equilibrated fabrics are measured within 2 days of treatment. Treated fabrics are laid flat and stacked no more than 10 cloths high while equilibrating. Compression, Friction and Stiffness measurements are all conducted under the same environmental conditions use during the conditioning/equilibration step.

Preparation of Coated Fabric Cloths for 3D Feel Measurements:

Three types of measurements are made on the same day on each treated fabric cloth—1 Compression, 1 Friction, and 2 Stiffness measures, using at least 10 replicate fabric cloths for each test treatment and for the PDMS control-treatment. Compression, Friction, and Stiffness measurements are all conducted under the same environmental conditions use during the conditioning/equilibration step, namely; 23° C. and 50% Relative Humidity. A fabric cloth is obtained (1). The fabric's tag/label side is placed down and the face of the fabric, (3), is then defined as the side that is upwards. If there is no tag and the fabric is different on the front and back, it is important to establish one side of the terry fabric as being designated "face" and be consistent with that designation across all fabric cloths. The fabric (1) is then oriented so that the bands (2*a*, 2*b*) (which are parallel to the weft of the weave) are on the right and left and the top of the pile loops are pointing towards the left as indicated by the arrow (4)—see FIG. 1. The fabrics are marked with a permanent ink marker pen to create straight lines (5*a*, 5*b*, 5*c*, 5*d*), parallel to and 2.54 cm in from the top and bottom sides and the bands. All measurements are made within the area defined by the marker pen lines (5*a*)—see FIG. 1 for details.

Table 1 lists the fabric sample size for each of the measurements. The fabrics are marked accordingly with a permanent ink marker pen while carefully aligning the straight lines with the warp and weft directions of the fabrics. Compression is measured before cutting the samples for bending and friction measurements. Cutting is done with fabric shears, along the marked line—see FIG. 1.

TABLE 1

| | Sample Size | Additional Information |
|---|---|---|
| Compression | Compression Area (6): 10.2 cm diameter | Mark diameter on fabric only; they are not cut out |
| Friction | Sled Area (7): 11.4 cm × 6.4 cm | Drag Area (8) (not marked nor cut out): ~11.4 cm × 6.4 cm |
| Stiffness/Bend | Taber Specimen Cut 7.6 cm × 3.8 cm | Cut in half for two samples (9a, 9b) 3.8 cm × 3.8 cm each |

Compression Measure:

Compression of the fabric is measured by a tensile tester. Suitable tensile testers for this measurement are single or dual column tabletop systems for low-force applications of 1 to 10 kN, or systems for higher force tensile testers. Suitable testers are the MTS Insight Series (MTS Systems Corporation, Pittsburgh, Pa.) and the Instron's 5000 series for Low-Force Testing. A 100 Newton load cell is used to make the measures. A sample stage is a flat circular plate, machined of metal harder than 100 HRB (Rockwell Hardness Scale) and has a diameter of 15 cm. This is used for the bottom platen. A suitable stage is Model 2501-163 (Instron, Norwood, Mass.). The compression head is made of a hard plastic such as polycarbonate or Lexan. It is 10.2 cm in diameter and 2.54 cm thick with a smooth surface. The following settings are used to make the measure:

| | |
|---|---|
| Data Acquisition Rate: | 10 Hz |
| Platen Separation: | 10.00 mm |
| Compression Head Rate: | 1 mm/min |
| Compression Stop 1: | 2.80 mm |
| Compression Stop 2: | 85% of load cell |
| Load Units: | Kgf |

The gap between platens is set at 10.00 mm.

The fabric is placed on the bottom platen and aligned with the compression area mark (FIG. 1) under the compression head, without billows or folds in the fabric due to placement on the sample plate. After the measurement is taken, the load and extension values for each sample are saved. The bottom platen and compression head are cleaned with an alcohol wipe and allowed to dry completely between sample treatments. For each treatment, ten replicate fabrics are measured.

Calculating the Compression Parameter:

The slope of the compression curve is derived in the following manner. The Y variable denotes the natural log of the measured load and the X variable denotes the extension. The slope is calculated using a simple linear regression of Y on X over the load range of 0.005 and 3.5 kgf. This is calculated for each fabric cloth measured and the value is reported as kgf/mm.

Friction Measures:

For the examples cited a Thwing-Albert FP2250 Friction/Peel Tester with a 2 kilogram force load cell is used to measure fabric to fabric friction. (Thwing Albert Instrument Company, West N.J.). The sled is a clamping style sled with a 6.4 by 6.4 cm footprint and weighs 200 g (Thwing Albert Model Number 00225-218). The distance between the load cell to the sled is set at 10.2 cm. The crosshead arm height to the sample stage is adjusted to 25 mm (measured from the bottom of the cross arm to the top of the stage) to ensure that the sled remains parallel to and in contact with the fabric during the measurement. The following settings are used to make the measure:

| | |
|---|---|
| T2 (Kinetic Measure): | 10.0 sec |
| Total Time: | 20.0 sec |
| Test Rate: | 20.0 cm/min |

Figure 2:
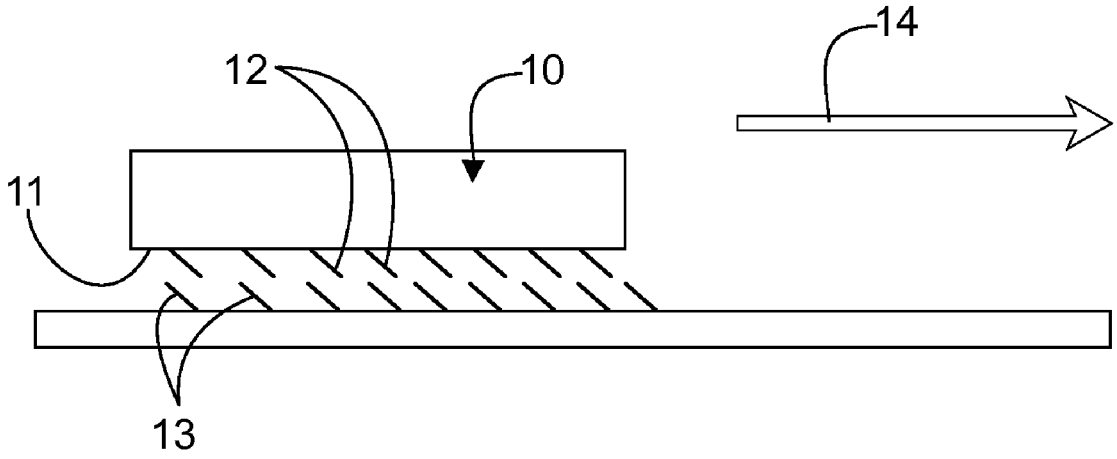
FIG. 2 is an elevation view of fabric cloth during taber friction testing

The 11.4 cm×6.4 cm cut fabric piece is attached, per FIG. 2, to the clamping sled (10) with the face down (11) (so that the face of the fabric on the sled is pulled across the face of the fabric on the sample plate) which corresponds to friction sled cut (7) of FIG. 1. Referring to FIG. 2, the loops of the fabric on the sled (12) are oriented such that when the sled (10) is pulled, the fabric (11) is pulled against the nap of the loops (12) of the test fabric cloth (see FIG. 2). The fabric from which the sled sample is cut is attached to the sample table such that the sled drags over the area labeled "Friction Drag Area" (8) as seen in FIG. 1. The loop orientation (13) is such that when the sled is pulled over the fabric it is pulled against the loops (13) (see FIG. 2). Direction arrow (14) indicates direction of sled (10) movement.

The sled is placed on the fabric and attached to the load cell. The crosshead is moved until the load cell registers between ~1.0-2.0 gf. Then, it is moved back to the back until the load reads 0.0 gf. At this point the measurement is made and the Kinetic Coefficient of Friction (kCOF) recorded. For each treatment, at least ten replicate fabrics are measured.

A comparable instrument to measure fabric to fabric friction would be any instrument capable of measuring frictional properties of a horizontal surface. Any 200 gram sled that has footprint of 6.4 cm by 6.4 cm and has a way to securely clamp the fabric without stretching it would be comparable. It is important, though, that the sled remains parallel to and in contact with the fabric during the measurement. The kinetic coefficient of friction is averaged over the time frame starting at 10 seconds and ending at 20 seconds for the sled speed set at 20.0 cm/min.

Stiffness Measures (Also Known as Bend):

Assessment of fabric bend is measured by a Taber Stiffness Tester (Model 150-E, Taber Industries, North Tonawanda, N.Y.). The following settings are used for the Taber:

| | |
|---|---|
| Range | 2 |
| Rollers | Up |
| Weight | Compensator 10 g |
| Cycles | 5 |
| Direction | Left & Right |
| Deflection | 15 Degrees |

The sample for the Taber measure is placed into the clamps such that the face of the fabric is to the right and rows of loops are vertical and the loops of the fabric pointing outward, not towards the instruments. The Taber clamps are tightened just enough to secure the fabrics and not cause deformation at the pivotal point. The measurement is made and the average stiffness units (SU) for each fabric is recorded. Taber Stiffness Units are defined as the bending moment of ⅕ of a gram applied to a 3.81 cm wide specimen at a 5 cm test length, flexing it to an angle of 15°. A Stiffness Unit is the equivalent of one gram force centimeter. For each treatment, two measurements are made on each of at least ten replicate fabrics. The average value for each fabric is calculated from the two measures performed on that fabric. The clamps and rollers are cleaned with an alcohol wipe and allowed to dry completely between sample treatments.

A comparable instrument to measure stiffness would be a Kawabata KES-FB2, Kato-Tech Corporation LTD. Japan. If a Kawabata stiffness tester is used, then an additional 10 fabrics should be prepared, since for each test 20 by 20 cm samples are used. They are bent in the weft orientation. The following settings are used: Sensitivity=20 and Curvature=2.5 $cm^{-1}$. The bending rigidity is recorded for each measure.

Data Analysis & Statistical Methods:

For the PDMS control-treatment and for each test-treatment material, the mean for each of the three methods (stiffness, friction and compression) is calculated from the ten or more replicate measurements conducted. The mean for each test treatment material is divided by the PDMS control-treatment mean for each respective test method, using only data measured on the same day. This results in a ratio value for each test-treatment, for each of the three Feel Methods.

Friction Ratio Value for Treatment *X*=Friction Mean of Test Treatment *X*/Friction Mean of PDMS Control Treatment;

Compression Ratio Value for Treatment *X*=Compression Mean of Test Treatment *X*/Compression Mean of PDMS Control Treatment;

Bending Ratio Value for Treatment *X*=Bending Mean of Test Treatment *X*/Bending Mean of PDMS Control Treatment;

wherein "X" is the test material.

To compute the 95% confidence interval for ratios the Generalized Estimation Equation based approach is used, as described in the following publication: *Ratio Estimation via Poisson Regression and Generalized Estimating Equations* (2008), Jorge G. Morel and Nagaraj K. Neerchal, Statistics and Probability Letters, Volume 78, Issue 14, 2188-2193.

Data of various test materials and PDMS are evaluated for Friction, Compression, and Stiffness per the method described herein. The structures and methods of making these materials are detailed in the Examples section.

| Material | Friction[A] | Compression[B] | Stiffness[C] |
|---|---|---|---|
| Quaternary Ammonium[1] | 0.806-0.826 | 0.798-0.904 | 0.391-0.484 |
| *SLM 21230 - mod B | 0.809-0.866 | 0.765-0.863 | 0.476-0.585 |
| *SLM 2121-4 | 0.573-0.716 | 0.739-0.801 | 0.449-0.604 |
| *SLM 21230 | 0.860-0.890 | 0.731-0.794 | 0.489-0.637 |
| SLM 466-01-05 | 0.898-0.921 | 0.772-0.854 | 0.755-0.898 |
| PDMS | 1 | 1 | 1 |

[1]Bis-(2-hydroxyethyl)-dimethylammonium chloride fatty acid ester available from Evonik.
[A]A number lower than 1 is lower friction relative to PDMS.
[B]A number lower than 1 is lower compression relative to PDMS.
[C]A number lower than 1 is lower stiffness (bending) relative to PDMS.
*Compounds within the scope of the present invention as providing unique three dimensional fabric feel benefits.

SLM 2121-4, SLM 21230, are compounds that are within the scope of the present invention that provide unique three dimension fabric feel benefits. Without wishing to be bound by theory, amine content, specifically that of the "capping group" of the silicone fluid, molecular weight and amine/dicarbonal ratio greatly influence the unique fabric feel benefit in which the silicone imparts when delivered to a consumer fabric via the laundering cycle. Given the silicones of interest, it is determined that by adjusting each these aspects of the silicone, one can modify the silicone to optimize the fabric feel benefits with which it provides. Base on the performance vectors listed below, it was determined that as you increase the nitrogen content, decrease the Amine/Dicarbonal ratio and increase the molecular weight, you can optimize three dimensional fabric feel performance.

| | Nitrogen content of capping group | Amine/ Dicarbonal ratio | Structural Information Molecular Weight |
|---|---|---|---|
| SLM 4660105 | ↓ Nitrogen | ↓ Amine/Dicarb | ↑ MW |
| SLM 21230 | ↓ Nitrogen | ↑ Amine/Dicarb | ↓ MW |
| SLM 21230 mod B | ↓ Nitrogen | ↓ Amine/Dicarb | ↑ MW |
| SLM 2121419 | ↑ Nitrogen | ↓ Amine/Dicarb | ↑ MW |

Ratio Values

One aspect of the invention provides a Friction Test Ratio from about 0.83 to about 0.90, alternatively from about 0.85 to about 0.89.

Another aspect of the invention provides a Compression Test Ratio lower than about 0.86, alternatively from about 0.70 to about 0.86, alternatively from about 0.73 to about 0.86.

Another aspect of the invention provides a Bending Test Ratio lower than about 0.67, alternatively from about 0.35 to about 0.67, alternatively from about 0.39 to about 0.64, alternatively from about 0.44 to about 0.64.

QCM-D Method for Measuring Fabric Deposition Kinetics of a Silicone Emulsion

Another aspect of the invention provides for methods of assessing the Tau Value of a silicone emulsion. Preferably the Tau Value is below 10, more preferably below 5.

This method describes the derivation of a deposition kinetics parameter (Tau) from deposition measurements made using a quartz crystal microbalance with dissipation measurements (QCM-D) with fluid handling provided by a high performance liquid chromatography (HPLC) pumping system. The mean Tau value is derived from triplicate runs, with each run consisting of measurements made using two flow cells in series.

QCM-D Instrument Configuration

Figure 3:
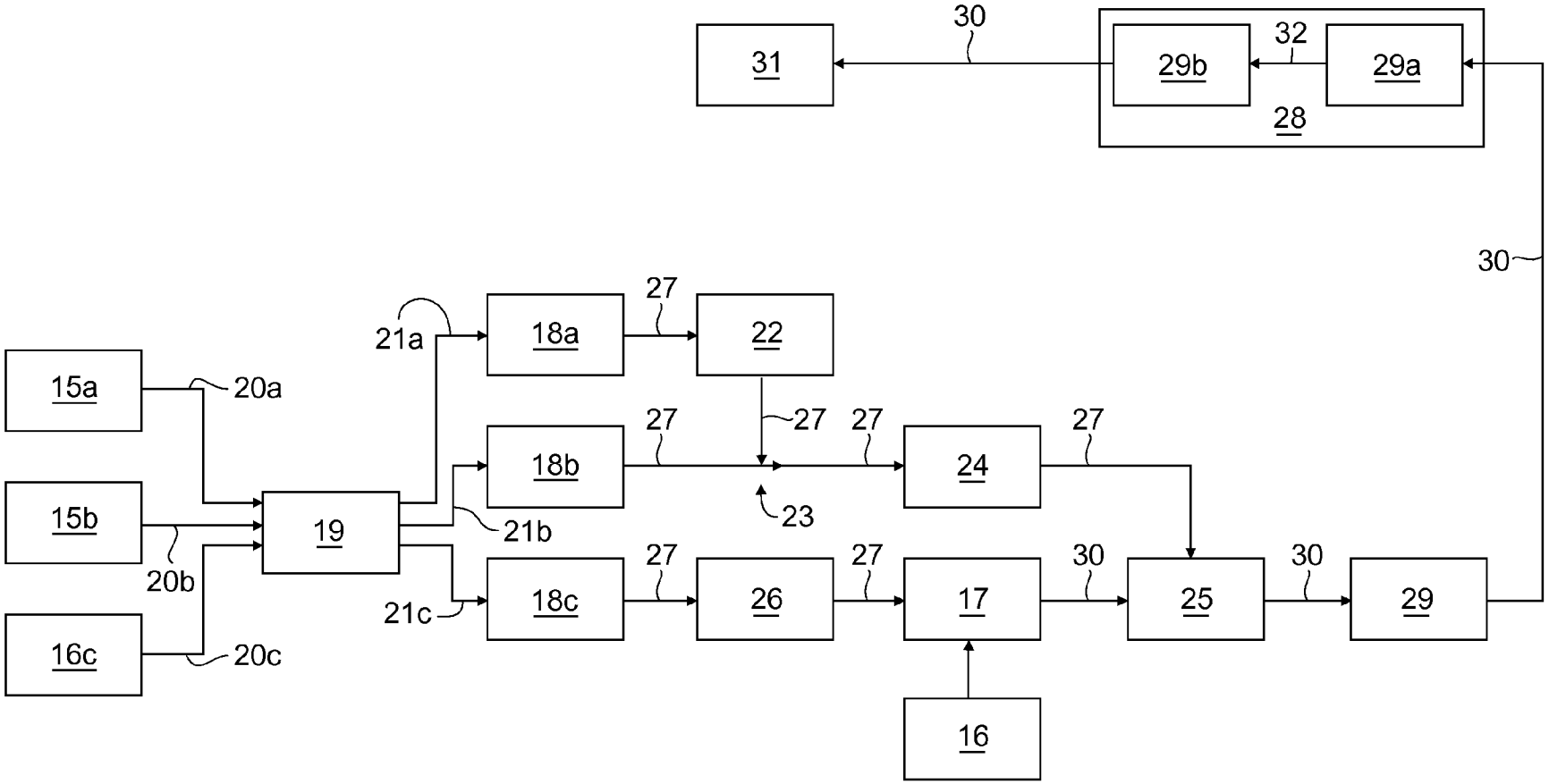
FIG. 3 is a schematic of a combined QCM-D and HPLC Pump set-up.

A schematic of the combined QCM-D and pumping system is shown in FIG. 3.

Carrier Fluid Reservoirs:

Three one liter or greater carrier fluid reservoirs are utilized (15*a*, 15*b*, 15*c*) as follows: Reservoir A: Deionized water (18.2 MΩ); Reservoir B: Hard water (15 mM $CaCl_2.2H_2O$ and 5 mM $MgCl_2.6H_2O$ in 18.2 MΩ water); and Reservoir C: Deionized water (18.2 MΩ). All reservoirs are maintained at ambient temperature (approximately 20° C. to 25° C.).

Fluids from these three reservoirs can be mixed in various concentrations under the control of a programmable HPLC pump controller to obtain desired water hardness, pH, ionic strength, or other characteristics of the sample. Reservoirs A and B are used to adjust the water hardness of the sample, and reservoir C is used to add the sample (16) to the fluid stream via the autosampler (17).

Carrier Fluid Degasser:

Prior to entering the pumps (18*a*, 18*b*, 18*c*), the carrier fluids must be degassed. This can be achieved using a 4-channel vacuum degasser (19) (a suitable unit is the Rheodyne/Systec #0001-6501, Upchurch Scientific, a unit of IDEX Corporation, 619 Oak Street, P.O. Box 1529 Oak Harbor, Wash. 98277). Alternatively, the carrier fluids can be degassed using alternative means such as degassing by vacuum filtration. The tubing used to connect the reservoirs to the vacuum degasser (20*a*, 20*b*, 20*c*) is approximately 1.60 mm nominal inside diameter (ID) PTFE tubing (for example, Kimble Chase Life Science and Research Products LLC 1022 Spruce Street PO Box 1502 Vineland N.J. 08362-1502, part number 420823-0018).

Pumping System:

Carrier fluid is pumped from the reservoirs using three single-piston pumps (18*a*, 18*b*, 18*c*), as typically used for HPLC (a suitable pump is the Varian ProStar 210 HPLC Solvent Delivery Modules with 5 ml pump heads, Varian Inc., 2700 Mitchell Drive, Walnut Creek Calif. 94598-1675 USA). It should be noted that peristaltic pumps or pumps equipped with a proportioning valve are not suitable for this method. The tubing (21*a*, 21*b*, 21*c*) used to connect the vacuum degasser to the pumps is the same dimensions and type as those connecting the reservoirs to the degassers.

Pump A is used to pump fluid from Reservoir A (deionized water). Additionally, Pump A is equipped with a pulse dampener (22) (a suitable unit is the 10 ml volume 60 MPa Varian part #0393552501, Varian Inc., 2700 Mitchell Drive, Walnut Creek Calif. 94598-1675 USA) through which the output of Pump A is fed.

Pump B is used to pump fluid from Reservoir B (hard water). The fluid outflow from Pump B is joined to the fluid outflow of Pump A using a T-connector (23). This fluid then passes through a backpressure device (24) that maintains at least approximately 6.89 MPa (a suitable unit is the Upchurch Scientific part number P-455, a unit of IDEX Corporation, 619 Oak Street, P.O. Box 1529 Oak Harbor, Wash. 98277) and is subsequently delivered to a dynamic mixer (25).

Pump C is used to pump fluid from Reservoir C (deionized water). This fluid then passes through a backpressure device (26) that maintains at least approximately 6.89 MPa (a suitable unit is the Upchurch Scientific part number P-455, a unit of IDEX Corporation, 619 Oak Street, P.O. Box 1529 Oak Harbor, Wash. 98277) prior to delivering fluid into the autosampler (17).

Autosampler:

Automated loading and injection of the test sample into the flow stream is accomplished by means of an autosampler device (17) equipped with a 10 ml, approximately 0.762 mm nominal ID sample loop (a suitable unit is the Varian ProStar 420 HPLC Autosampler using a 10 ml, approximately 0.762 mm nominal ID sample loop, Varian Inc., 2700 Mitchell Drive, Walnut Creek Calif. 94598-1675 USA). The tubing (27) used from the pump C outlet to the backpressure device (26), and from the backpressure device (26) to the autosampler (17) is approximately 0.254 mm nominal ID polyetheretherketone (PEEK) tubing (suitable tubing can be obtained from Upchurch Scientific, a unit of IDEX Corporation, 619 Oak Street, P.O. Box 1529 Oak Harbor, Wash. 98277). Fluid exiting the autosampler is delivered to a dynamic mixer (25).

Dynamic Mixer:

All of the flow streams are combined in a 1.2 ml dynamic mixer (25) (a suitable unit is the Varian part #0393555001 (PEEK), Varian Inc., 2700 Mitchell Drive, Walnut Creek Calif. 94598-1675 USA) prior to entering into the QCM-D instrument (28). The tubing used to connect pumps A & B (18*a*, 18*b*) to the dynamic mixer via the pulse dampener (22) and backpressure device (24) is the same dimensions and type as that connecting the pump C (18*c*) to the autosampler via the backpressure device (26). The fluid exiting the dynamic mixer passes through an approximately 0.138 MPa backpressure device (29) (a suitable unit is the Upchurch Scientific part number P-791, a unit of IDEX Corporation, 619 Oak Street, P.O. Box 1529 Oak Harbor, Wash. 98277) before entering the QCM-D instrument.

QCM-D:

The QCM-D instrument should be capable of collecting frequency shift (Δf) and dissipation shift (ΔD) measurements relative to bulk fluid over time using at least two flow cells (29*a*, 29*b*) whose temperature is held constant at 25 C±0.3 C. The QCM-D instrument is equipped with two flow cells, each having approximately 140 μl in total internal fluid volume, arranged in series to enable two measurements (a suitable instrument is the Q-Sense E4 equipped with QFM 401 flow cells, Biolin Scientific Inc. 808 Landmark Drive, Suite 124 Glen Burnie, Md. 21061 USA). The theory and principles of the QCM-D instrument are described in U.S. Pat. No. 6,006,589.

The tubing (30) used from the autosampler to the dynamic mixer and all device connections downstream thereafter is approximately 0.762 mm nominal ID PEEK tubing (Upchurch Scientific, a unit of IDEX Corporation, 619 Oak Street, P.O. Box 1529 Oak Harbor, Wash. 98277). Total fluid volume between the autosampler (17) and the inlet to the first QCM-D flow cell (29*a*) is 3.4 ml±0.2 ml.

The tubing (32) between the first and second QCM-D flow cell in the QCM-D instrument should be approximately 0.762 mm nominal ID PEEK tubing (Upchurch Scientific, a unit of IDEX Corporation, 619 Oak Street, P.O. Box 1529 Oak Harbor, Wash. 98277) and between 8 and 15 cm in length. The outlet of the second flow cell flows via PEEK tubing (30) 0.762 mm ID, into a waste container (31), which must reside between 45 cm and 60 cm above the QCM-D flow cell #2 (29*b*) surface. This provides a slight amount of backpressure, which is necessary for the QCM-D to maintain a stable baseline and prevent siphoning of fluid out of the QCM-D.

Test Sample Preparation

Silicone test materials are to be prepared for testing by being made into a simple emulsion of at least 0.1% test material concentration (wt/wt), in deionised water (i.e., not a complex formulation), with a particle size distribution which is stable for at least 48 hrs at room temperature. Those skilled in the art will understand that such suspensions can be produced using a variety of different surfactants or solvents, depending upon the characteristics of each specific material. Examples of surfactants & solvents which may be successfully used to create such suspensions include: ethanol, Isofol 12, Arquad HTL8-MS, Tergitol 15-S-5, Terigtol 15-S-12, TMN-10 and TMN-3. Salts or other chemical(s) that would affect the deposition of the active should not to be added to the test sample. Those skilled in the art will understand that such suspensions can be made by mixing the components together using a variety of mixing devices. Examples of suitable overhead mixers include: IKA Labortechnik, and Janke & Kunkel IKA WERK, equipped with impeller blade Divtech Equipment R1342. It is important that each test sample suspension has a volume-weighted, mode particle size of <1,000 nm and preferably >200 nm, as measured >12 hrs after emulsification, and <12 hrs prior to its use in the testing protocol. Particle size distribution is measured using a static laser diffraction instrument, operated in accordance with the manufactures instructions. Examples of suitable particle sizing instruments include: Horiba Laser Scattering Particle Size and Distributer Analyzer LA-930 and Malvern Mastersizer.

The silicone emulsion samples, prepared as described above, are initially diluted to 2000 ppm (vol/vol) using degassed 18.2 MΩ water and placed into a 10 ml autosampler vial (Varian part RK60827510). The sample is subsequently diluted to 800 ppm with degassed, deionized water (18.2 MΩ) and then capped, crimped and thoroughly mixed on a Vortex mixer for 30 seconds.

QCM-D Data Acquisition

Microbalance sensors fabricated from AT-cut quartz and being approximately 14 mm in diameter with a fundamental resonant frequency of 4.95 MHz±50 KHz are used in this method. These microbalance sensors are coated with approximately 100 nm of gold followed by nominally 50 nm of silicon dioxide (a suitable sensor is available from Q-Sense, Biolin Scientific Inc. 808 Landmark Drive, Suite 124 Glen Burnie, Md. 21061 USA). The microbalance sensors are loaded into the QCM-D flow cells, which are then placed into the QCM-D instrument. Using the programmable HPLC pump controller, the following three stage pumping protocol is programmed and implemented.

Fluid Flow Rates for Pumping Protocol:

Fluid flow rates for pumps are: Pump A: Deionized water (18.2 MΩ) at 0.6 ml/min; Pump B: Hard water (15 mM CaCl2.2H2O and 5 mM MgCl2.6H2O in 18.2 MΩ water) at 0.3 ml/min; and Pump C: Deionized water (18.2 MΩ) at 0.1 ml/min.

These flow rates are used throughout the three stages delineated below. The three stages described below are collectively referred to as the "pumping protocol". The test sample only passes over the microbalance sensor during Stage 2.

Pumping Protocol Stage 1: System Equilibration

Fluid flow using pumps A, B, and C is started and the system is allowed to equilibrate for at least 60 minutes at 25 C. Data collection using the QCM-D instrument should begin once fluid flow has begun. The QCM-D instrument is used to collect the frequency shift (Δf) and dissipation shift (ΔD) at the third, fifth, seventh, and ninth harmonics (i.e. f3, f5, f7, and f9 and d3, d5, d7, and d9 for the frequency and dissipation shifts, respectively) by collecting these measurements at each of these harmonics at least once every four seconds.

Stage 1 should be continued until stability is established. Stability is defined as obtaining an absolute value of less than 0.75 Hz/hour for the slope of the $1^{st}$ order linear best fit across 60 contiguous minutes of frequency shift and also an absolute value of less than 0.2 Hz/hour for the slope of the $1^{st}$ order linear best fit across 60 contiguous minutes of dissipation shift, from each of the third, fifth, seventh, and ninth harmonics. Meeting this requirement may require restarting this stage and/or replacement of the microbalance sensor.

Once stability has been established, the sample to be tested is placed into the appropriate position in the autosampler device for uptake into the sample loop. Six milliliters of the test sample is then loaded into the sample loop using the autosampler device without placing the sample loop in the path of the flow stream. The flow rate used to load the sample into the sample loop should be less than 0.5 ml/min to avoid cavitation.

Pumping Protocol Stage 2: Test Sample Analysis

At the beginning of this stage, the sample loop loaded with the sample is now placed into the flow stream of fluid flowing into the QCM-D instrument using the auto sampler switching valve. This results in the dilution and flow of the test sample across the QCM-D sensor surfaces. Data collection using the QCM-D instrument should continue throughout this stage. The QCM-D instrument is used to collect the frequency shift (Δf) and dissipation shift (ΔD) at the third, fifth, seventh, and ninth harmonics (i.e. f3, f5, f7, and f9 and d3, d5, d7, and d9 for the frequency and dissipation shifts, respectively) by collecting these measurements at each of these harmonics at least once every four seconds. Flow of the test sample across the QCM-D sensor surfaces should proceed for 30 minutes before proceeding to Stage 3.

Pumping Protocol Stage 3: Rinsing

In Stage 3, the sample loop in the autosampler device is removed from the flow stream using the switching valve present in the autosampler device. Fluid flow is continued as described in Stage 1 without the presence of the test sample. This fluid flow will rinse out residual test sample from the tubing, dynamic mixer, and QCM-D flow cells. Data collection using the QCM-D instrument should continue throughout this stage. The QCM-D instrument is used to collect the frequency shift (Δf) and dissipation shift (ΔD) at the third, fifth, seventh, and ninth harmonics (i.e. f3, f5, f7, and f9 and d3, d5, d7, and d9 for the frequency and dissipation shifts, respectively) by collecting these measurements at each of these harmonics at least once every four seconds. Flow of the sample solution across the QCM-D sensor surfaces should proceed for 30 minutes of rinsing before stopping the flow and QCM-D data collection. The residual sample is removed from the sample loop in the autosampler through the use of nine 10 ml rinse cycles of deionized (18 MΩ) water, each drained to waste.

Upon completion of the pumping protocol, the QCM-D flow cells should be removed from the QCM-D instrument, disassembled, and the microbalance sensors discarded. The metal components of the flow cell should be cleaned by soaking in HPLC grade methanol for one hour followed by subsequent rinses with methanol and HPLC grade acetone. The non-metal components should be rinsed with deionized water (18 MΩ). After rinsing, the flow cell components should be blown dry with compressed nitrogen gas.

Data Analysis

Voigt Viscoelastic Fitting of the QCM-D Frequency Shift and Dissipation Shift Data Analysis of the frequency shift (Δf) and dissipation shift (ΔD) data is performed using the Voigt viscoelastic model as described in M. V. Voinova, M. Rodahl, M. Jonson and B. Kasemo "Viscoelastic Acoustic Response of Layered Polymer Films at Fluid-Solid Interfaces: Continuum Mechanics Approach" *Physica Scripta* 59: 391-396 (1999). The Voigt viscoelastic model is included in the Q-Tools software (Q-Sense, version 3.0.7.230 and earlier versions), but could be implemented in other software programs. The frequency shift (Δf) and dissipation shift (ΔD) for each monitored harmonic should be zeroed approximately 5 minutes prior to injection of the test sample (i.e. five minutes prior to the beginning of Stage 2 described above).

Fitting of the Δf and ΔD data using the Voigt viscoelastic model is performed using the third, fifth, seventh, and ninth harmonics (i.e. f3, f5, f7, and f9, and d3, d5, d7, and d9, for the frequency and dissipation shifts, respectively) collected during Stages 2 and 3 of the pumping protocol described above. Voigt model fitting is performed using descending incremental fitting, i.e. beginning from the end of Stage 3 and working backwards in time.

In the fitting of Δf and ΔD data obtained from QCM-D measurements, a number of parameters must be determined or assigned. The values used for these parameters may alter the output of the Voigt viscoelastic model, so these parameters are specified here to remove ambiguity. These parameters are classified into three groups: fixed parameters, statically fit parameters, and dynamically fit parameters. The fixed parameters are selected prior to the fitting of the data and do not change during the course of the data fitting. The fixed parameters used in this method are: the density of the carrier fluid used in the measurement (1000 $kg/m^3$); the viscosity of the carrier fluid used in the measurement (0.001 kg/m–s); and the density of the deposited material (1000 $kg/m^3$).

Statically and dynamically fit parameters are optimized over a search range to minimize the error between the measured and predicted frequency shift and dissipation shift values.

Statically fit parameters are fit using the first time point of the data to be fit (i.e. the last time point in Stage 2) and then maintained as constants for the remainder of the fit. The statically fit parameter in this method is the elastic shear modulus of the deposited layer was bound between 1 Pa and 10000 Pa, inclusive.

Dynamically fit parameters are fit at each time point of the data to be fit. At the first time point to be fit, the optimum dynamic fit parameters are selected within the search range described below. At each subsequent time point to be fit, the fitting results from the prior time point are used as a starting point for localized optimization of the fit results for the current time point. The dynamically fit parameters in this method are: the viscosity of the deposited layer was bound between 0.001 kg/m−s and 0.1 kg-m-s, inclusive; and the thickness of the deposited layer was bound between 0.1 nm and 1000 nm, inclusive.

Derivation of Deposition Kinetics Parameter (Tau) from Fit QCM-D Data

Once the layer viscosity, layer thickness, and layer elastic shear modulus are determined from the frequency shift and dissipation shift data using the Voigt viscoelastic model, the deposition kinetics of the test sample can be determined. Determination of the deposition kinetics parameter (Tau) is performed by fitting an exponential function to the layer viscosity using the form:

$$\text{Viscosity}(t) = \text{Amplitude}\left(1 - \exp\left(\frac{t - t_0}{Tau}\right)\right) + \text{Offset} \qquad \text{Eqn. 1}$$

where viscosity, amplitude, and offset have units of kg/m−s and t, $t_0$, and Tau have units of minutes, and "exp" refers to the exponential function $e^x$. The initial timepoint of this function ($t_0$) is determined by the time at which the test sample begins flowing across the QCM-D sensor surface, as determined by the absolute value of the frequency shift on the $3^{rd}$ harmonic ($|\Delta f3|$) being greater than 1 Hz. Equation 1 should be used only on data which fall between $t_0$ and the end of stage 2. The amplitude of this function is determined by subtracting the maximum film viscosity determined from the Voigt viscoelastic model during stage 2 of the HPLC method from the minimum film viscosity determined from the Voigt viscoelastic model during stage 1 of the HPLC method. The offset of this function is the minimum layer viscosity determined from the Voigt viscoelastic model during stage 2 of the HPLC method. Tau is fit to minimize the sum of squared differences between the layer viscosity and the viscosity fit determined using Equation 1. Tau should be calculated to one decimal place. Fitted values for Tau determined from the two QCM-D flow cells in series should be averaged together to provide a single value for Tau for each run. Subsequently, Tau values from the triplicate runs should be averaged together to determine the mean Tau value for the test sample.

Quality Assurance

This sample should be analyzed to test and confirm proper functioning of the QCM-D instrument method. This test must be run successfully before valid data can be acquired.

Stability Test

The purpose of this test is to evaluate the stability of the QCM-D response (i.e. frequency shift and dissipation shift) throughout the pumping protocol described above. In this test, the sample injected during stage 2 of the pumping protocol described above should be degas sed, deionized water (18.2 MΩ). Frequency shift and dissipation shift data for the third, fifth, seventh, and ninth harmonics (f3, f5, f7, and f9 and d3, d5, d7, and d9 for the frequency and dissipation shifts, respectively) are to be monitored. For the purposes of this stability test, stability is defined as obtaining an absolute value of less than 0.75 Hz/hour for the slope of the $1^{st}$ order linear best fit across 30 contiguous minutes of frequency shift and also an absolute value of less than 0.2 Hz/hour for the slope of the $1^{st}$ order linear best fit across 30 contiguous minutes of dissipation shift, from each of the third, fifth, seventh, and ninth harmonics. If this stability criterion is not met during this test, this indicates failure of the stability test and evaluation of the implementation of the experimental method is required before further testing. Valid data cannot be acquired unless this stability test is run successfully.

Results

The Tau Value is calculated for four silicone emulsions.

| Material | Tau Value |
|---|---|
| SLM 21200 | 1.7 |
| SLM 2121-4 | 2.7 |
| SLM 21230 - mod B | 3.7 |

In one embodiment, the active comprises a Tau Value less than 10, preferably less than 5. alternatively from about 1 to about 10.

EXAMPLES

The following non-limiting examples are illustrative. Percentages are by weight unless otherwise specified. While particular aspects have been illustrated and described, other changes and modifications can be made without departing from the spirit and scope of the invention. It is therefore intended to cover in the appended claims all such changes and modifications that are within the scope of this invention.

Preparation of Organosiloxane Polymers

Example 1

2.066 mmol of bis(4-isocyanatocyclohexyl)methane (HMDI) was dissolved in 6.0 g THF in the reactor. 1.057 mmol α,ω-diaminopropyl polydimethylsiloxane (MW=10850 g/mol) (aminosilicone) was dissolved in a separate flask in 12 g IPA and 12 g THF and introduced into the addition funnel. PDMS oligomer solution is added dropwise onto the HMDI solution under strong agitation at room temperature. Then 1.009 mmol 1,3-diamino-2-hydroxypropane (chain extender) was dissolved in 6.0 g IPA, introduced into the addition funnel and added dropwise onto the prepolymer solution in the reactor to complete the reaction.

Progress and completion of the reactions were followed by FTIR spectroscopy monitoring the disappearance of strong isocyanate absorption peak at 2265 $cm^{-1}$ to produce the target structure.

Example 2

4.132 mmol of bis(4-isocyanatocyclohexyl)methane (HMDI) was dissolved in THF in the reactor. 1.057 mmol α,ω-diaminopropyl polydimethylsiloxane (MW=10850 g/mol) (aminosilicone) was dissolved in a separate flask in 12 g IPA and 12 g THF and introduced into the addition funnel. PDMS solution is added dropwise onto the HMDI solution under strong agitation at room temperature. Then 2.019 mmol) 1,3-diamino-2-hydroxypropane (chain extender) was dissolved in 6.0 g IPA, introduced into the addition funnel and added dropwise onto the prepolymer solution in the reactor to complete the reaction.

Progress and completion of the reactions were followed by FTIR spectroscopy monitoring the disappearance of strong isocyanate absorption peak at 2265 $cm^{-1}$ to produce the target structure.

Example 3

2.066 mmol of bis(4-isocyanatocyclohexyl)methane (HMDI) was dissolved in THF in the reactor. 1.057 mmol α,ω-diaminopropyl polydimethylsiloxane (MW=3200 g/mol) (aminosilicone) was dissolved in a separate flask in 12 g IPA and 12 g THF and introduced into the addition funnel. PDMS solution is added dropwise onto the HMDI solution under strong agitation at room temperature. Then 1.009 mmol of 2-methylpentamethylenediamine (Dytek A™) was dissolved in 6.0 g IPA, introduced into the addition funnel and added dropwise onto the prepolymer solution in the reactor to complete the reaction.

Progress and completion of the reactions were followed by FTIR spectroscopy monitoring the disappearance of strong isocyanate absorption peak at 2265 $cm^{-1}$ to produce the target structure.

Example 4

0.930 g (3.545 mmol) bis(4-isocyanatocyclohexyl)methane (HMDI) was dissolved in 6.0 g THF in the reactor. 16.282 g (0.517 mmol) PDMS-31,500 oligomer (Mn=31,500 g/mol) was dissolved in a separate flask in 20 g IPA and 25 g THF and introduced into the addition funnel. PDMS solution is added dropwise onto the HMDI solution under strong agitation at room temperature. Then 0.352 g (3.028 mmol) 2-methylpentamethylenediamine (Dytek A™) was dissolved in 12.0 g IPA, introduced into the addition funnel and added dropwise onto the prepolymer solution in the reactor to complete the reaction. Progress and completion of the reactions were followed by FTIR spectroscopy monitoring the disappearance of strong isocyanate absorption peak at 2265 $cm^{-1}$ to produce the target molecule.

toring the disappearance of strong isocyanate absorption peak at 2265 $cm^{-1}$ to produce the target structure.

Example 6

0.8 g (5 mmol) toluene diisocyanate (TDI) was dissolved in THF in the reactor. 5.2 g (5.2 mmol) of α,ω-diaminopropyl polydimethylsiloxane (MW=1000 g/mol) (aminosilicone) was dissolved in a separate flask in 12 g IPA and introduced into the addition funnel. Aminosilicone solution is added dropwise onto the TDI solution under strong agitation at room temperature. The progress and completion of the reactions were followed by FTIR spectroscopy monitoring the disappearance of strong isocyanate absorption peak at 2265 $cm^{-1}$.

Example 7

The toluene diisocyanate in Example 6 is replaced by 5 mmol of hexamethylene diisocyanate.

Example 8

The toluene diisocyanate in Example 6 is replaced by 5 mmol of tetrabutylene diisocyanate.

Example (i)

SLM 21230-mod B

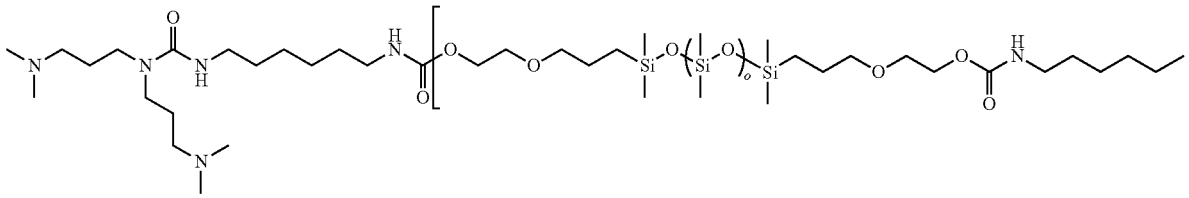

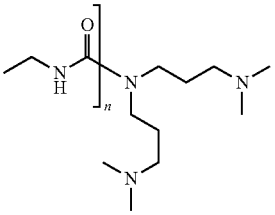

n = 2
o = 50

Example 5

2.066 mmol of bis(4-isocyanatocyclohexyl)methane (HMDI) was dissolved in THF in the reactor. 1.057 mmol α,ω-diaminopropyl polydimethylsiloxane (MW=3200 g/mol) (aminosilicone) and 2.11 g of amine terminated polycaprolactone (MW=2000) were dissolved in a separate flask in 12 g IPA and 12 g THF and introduced into the addition funnel. PDMS solution is added dropwise onto the HMDI solution under strong agitation at room temperature. Then 1.009 mmol of 2-methyl pentamethylenediamine (Dytek A™) was dissolved in 6.0 g IPA, introduced into the addition funnel and added dropwise onto the prepolymer solution in the reactor to complete the reaction. Progress and completion of the reactions were followed by FTIR spectroscopy moni- Two equivalents of α,ω-dihydrogenpolydimethylsiloxane (Available from Wacker Silicones, Munich, Germany), having degree of polymerization of 50, is mixed with 4 equivalents of 2-hydroxyethyl allyl ether and heated to 100° C. A catalytically amount of Karstedt's catalyst solution is added, whereupon the temperature of the reaction mixture rises to 119° C. and a clear product is formed. Complete conversion of the silicon-bonded hydrogen is achieved after one hour at 100 to 110° C. Two equivalents of N,N-bis[3-(dimethylamino)propyl]amine (Jeffcat Z130 available from Wacker Silicones, Munich, Germany) and 3 equivalents of hexamethylenediisocyanate (HDI) are then meteringly added in succession. Urethane formation is then catalyzed with a catalytic amount of di-n-butyltin dilaurate. After the batch has been held at 100° C. for 2 hours it is cooled down, forming a very viscous liquid. MW is approximately 10,000.

Example (ii)

SLM 21-214

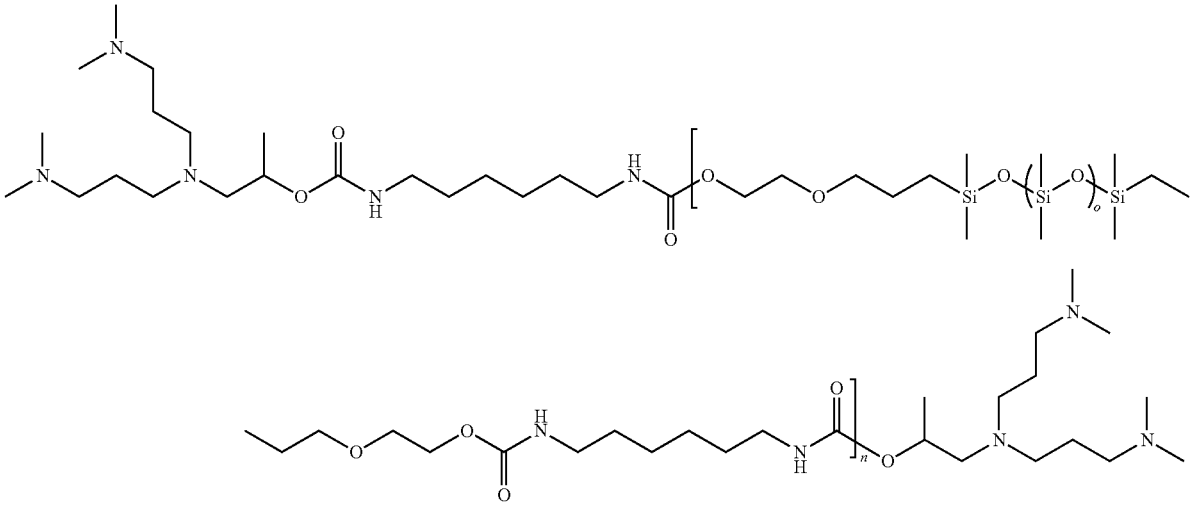

n = 2
o = 50

Two equivalents of α,ω-dihydrogenpolydimethylsiloxane (Available from Wacker Silicones, Munich, Germany), having degree of polymerization of 50, is mixed with 4 equivalents of 2-hydroxyethyl allyl ether and heated to 100° C. A catalytically amount of Karstedt's catalyst solution is added, whereupon the temperature of the reaction mixture rises to 119° C. and a clear product is formed. Complete conversion of the silicon-bonded hydrogen is achieved after one hour at 100 to 110° C. Two equivalents of N,N-bis(3-dimethylaminopropyl)isopropanolamine (Jeffcat ZR50 available from Wacker Silicones, Munich, Germany) and 3 equivalents of hexamethylenediisocyanate (HDI) are then meteringly added in succession at a reaction temperature of 120° C. Urethane formation is then catalyzed with a catalytic amount of di-n-butyltin dilaurate. After the batch has been held at 120° C. for 3 hours it is cooled down, forming a very viscous liquid.

Example (iii)

X-22-8699-3S

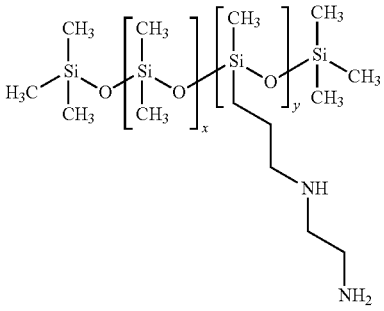

x = approximately 444
y = approximately 9

Synthesized via the equilibration reaction of hexamethyldisiloxane, octamethylcyclotetrasiloxane and, N,N',N",N'"-tetrakis(2-aminoethyl)-2,4,6,8-tetramethyl-cyclotetrasiloxane-2,4,6,8-tetrapropanamine, or the condensation reaction of aminoethylaminopropyltrimethoxysilane, a silanol or alkoxysilane terminated polydimethylsiloxane and a monosilanol or monoalkoxysilane terminated polydimethylsiloxane.

Example (iv)

SLM 21-230

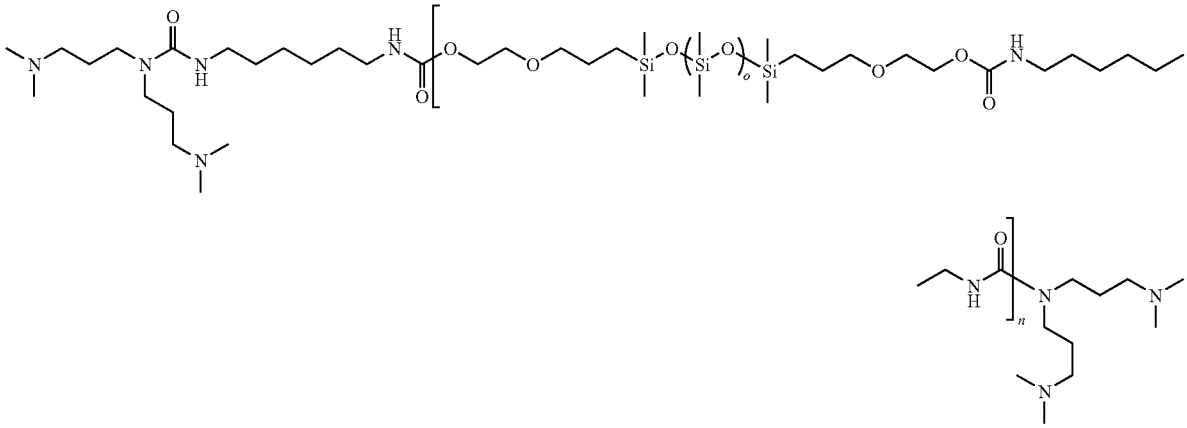

n = 1
o = 50

One equivalent of α,ω-dihydrogenpolydimethylsiloxane (Available from Wacker Silicones, Munich, Germany), having degree of polymerization of 50, is mixed with 2 equivalents of 2-hydroxyethyl allyl ether and heated to 100° C. A catalytically amount of Karstedt's catalyst solution is added, whereupon the temperature of the reaction mixture rises to 119° C. and a clear product is formed. Complete conversion of the silicon-bonded hydrogen is achieved after one hour at 100 to 110° C. Two equivalents of N,N-bis[3-(dimethylamino)propyl]amine (Jeffcat Z130 available from Wacker Silicones, Munich, Germany) and 2 equivalents of hexamethylenediisocyanate (HDI) are then meteringly added in succession. Urethane formation is then catalyzed with a catalytic amount of di-n-butyltin dilaurate. After the batch has been held at 100° C. for 2 hours it is cooled down, forming a very viscous liquid.

Example (v)

SLM 466-01-05

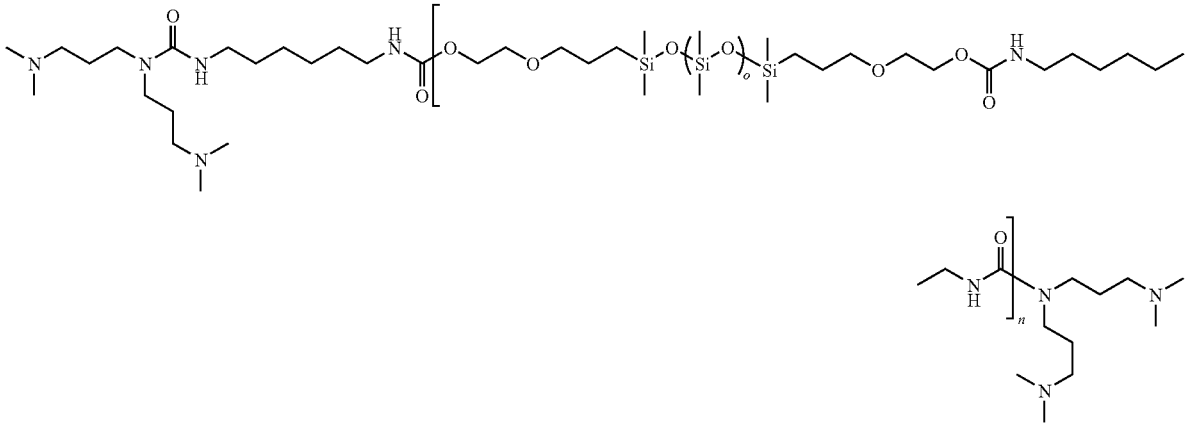

n = 2
o = 50

Two equivalents of α,ω-dihydrogenpolydimethylsiloxane (Available from Wacker Silicones, Munich, Germany), having degree of polymerization of 50, is reacted with 4 equivalents of 2-hydroxyethyl allyl ether. This product is then reacted with 2 equivalents of N,N-bis[3-(dimethylamino)propyl]amine (Jeffcat Z130 available from Wacker Silicones, Munich, Germany) and 3 equivalents of hexamethylenediisocyanate (HDI). MW is approximately 9,000.

Example (vi)

PDMS

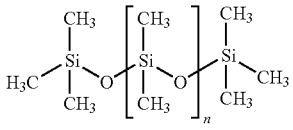

Synthesized via the equilibration reaction of hexamethyldisiloxane and octamethylcyclotetrasiloxane.

Example (vi)

SLM Emulsion 20.8 g of silicone SLM silicone is mixed with 2.1 g hydrogenated tallow alkyl (2-ethylhexyl), dimethyl ammonium methyl sulfates (sold under the product name ARQUAD HTL8-MS) for 15 minutes using at 250 rpm RPM using an overhead IKA WERK mixer. Four dilutions of water (11.7 g, 22.1 g, 22.1 g, 22.1 g) are added, with each dilution of water allowing for the solution to mix for an additional 15 minutes at 250 rpm. As a final step, glacial acetic acid was added drop-wise to reduce the pH to about 4.9 to 5.1 while the emulsion continued to mix. The weight of final mixture was 104 g. Subsequent to the emulsification is the particle size measurement using Horiba LA-930 to achieve a particle size between 100 nm to 900 nm at a refractive index of 102. If the average particle size of the emulsion was greater than 900 nm, emulsions are further processed by means of a homogenizer for approximately 3 minutes in 1 minute intervals.

TABLE II

Examples 9-16: Exemplary Rinse-Added Fabric Care Compositions
Rinse-Added fabric care compositions may be prepared as shown in Examples 9-16 by mixing together ingredients shown below:

| Component Material | Examples 9-16 Wt % |
|---|---|
| Di-tallowoylethanolester dimethylammonium chloride[1] | 11.0 |
| Silicone-containing polyurethane polymer from Examples 1-8 | 5.0 |
| Citral[2] | 0.2 |
| Water, perfume, suds suppressor, stabilizers & other optional ingredients | to 100% pH 2.5-3.0 |

TABLE III

Examples 17-22: Exemplary Rinse-Added Fabric Care Compositions
Rinse-Added fabric care compositions may be prepared as shown in Examples 17-22 by mixing together ingredients shown below:

| Component Material | 17 Wt % | 18 Wt % | 19 Wt % | 20 Wt % | 21 Wt % | 22 Wt % |
|---|---|---|---|---|---|---|
| Di-tallowoylethanolester dimethylammonium chloride[1] | 11.0 | 11.0 | 11.0 | 11.0 | 11.0 | 11.0 |
| Organosiloxane polymer-(X-26-2000[3]) | 5.0 | — | — | — | — | — |
| Organosiloxane polymer-(X26-2001[3]) | — | 5.0 | — | — | — | — |
| Organosiloxane polymer-(Silamer UR-50-50[4]) | — | — | 5.0 | — | — | — |
| Organosiloxane polymer-(466-01-05[5c]) | — | — | — | 5.0 | — | — |
| Organosiloxane polymer-(SLM 21-200[5b]) | — | — | — | — | 5.0 | |
| Organosiloxane polymer-(466-01-03[5a]) | — | — | — | — | — | 5.0 |
| Copolymer of acrylamide and methacrylamidopropyl trimethylammonium chloride[6] | 0.2 | 0.2 | 0.2 | 0.2 | 0.2 | 0.2 |
| Benzaldehyde[2] | 0.3 | 0.3 | 0.3 | 0.3 | 0.3 | 0.3 |
| Water, perfume, suds suppressor, stabilizers & other optional ingredients | to 100% pH = 3.0 | to 100% pH = 3.0 | to 100% pH 3.0 | to 100% pH 3.0 | to 100% pH 3.0 | to 100% pH 3.0 |

TABLE IV

Examples 23-27: Exemplary Liquid Detergent Fabric Care Compositions: Liquid detergent fabric care compositions may be prepared by mixing together the ingredients listed in the proportions shown.

| Component Material | 23 Wt % | 24 Wt % | 25 Wt % | 26 Wt % | 27 Wt % |
|---|---|---|---|---|---|
| C12-15 alkyl polyethoxylate (1.8) sulfate[7] | 20.1 | 20.1 | 20.1 | 20.1 | 20.1 |
| C12 alkyl trimethyl ammonium chloride[8] | 2.0 | 2.0 | 2.0 | 2.0 | 2.0 |
| 1,2 Propane diol | 4.5 | 4.5 | 4.5 | 4.5 | 4.5 |
| Ethanol | 3.4 | 3.4 | 3.4 | 3.4 | 3.4 |
| Neodol 23-9[9] | 0.36 | 0.36 | 0.36 | 0.36 | 0.36 |
| $C_{12-18}$ Fatty Acid[7] | 2.0 | 2.0 | 2.0 | 2.0 | 2.0 |
| Sodium cumene sulfonate | 1.8 | 1.8 | 1.8 | 1.8 | 1.8 |
| Citric acid | 3.4 | 3.4 | 3.4 | 3.4 | 3.4 |
| Protease[10] (32 g/L) | 0.42 | 0.42 | 0.42 | 0.42 | 0.42 |
| Fluorescent Whitening Agent[11] | 0.08 | 0.08 | 0.08 | 0.08 | 0.08 |
| DTPA | 0.5 | 0.2 | 0.2 | 0.2 | 0.2 |
| Ethoxylated polyamine[12] | 0.7 | 0.7 | 0.7 | 0.7 | 0.7 |
| Hydrogenated castor oil | 0.2 | 0.2 | 0.2 | 0.2 | 0.2 |

TABLE IV-continued

Examples 23-27: Exemplary Liquid Detergent Fabric Care Compositions: Liquid detergent fabric care compositions may be prepared by mixing together the ingredients listed in the proportions shown.

| Component Material | 23 Wt % | 24 Wt % | 25 Wt % | 26 Wt % | 27 Wt % |
|---|---|---|---|---|---|
| Copolymer of acrylamide and methacrylamidopropyl trimethylammonium chloride[6] | 0.3 | 0.3 | 0.3 | 0.3 | 0.3 |
| Organosiloxane polymer of Example 1-8 | 6.0 | — | — | — | — |
| Organosiloxane polymer-containing polyurethane bonds - (X-26-2000[3]) | — | 6.0 | | | — |
| Organosiloxane polymer - (Silamer UR-50-50[4]) | — | — | 6.0 | | — |
| Organosiloxane polymer- (SLM 21-200[5b]) | — | — | — | 6.0 | — |
| Organosiloxane polymer- (466-01-03[5a]) | — | — | — | — | 6.0 |
| Perfume Aldehyde - benzaldehyde[2] | 0.2 | 0.2 | 0.2 | 0.2 | 0.2 |
| Water, perfume, enzymes, suds suppressor, brightener, enzyme stabilizers & other optional ingredients | To 100% pH = 8.0 | To 100% pH = 8.0 | To 100% pH = 8.0 | To 100% pH = 8.0 | To 100% pH = 8.0 |

TABLE IV

Examples 28-32: Exemplary Liquid Detergent Fabric Care Compositions: Liquid detergent fabric care compositions may be prepared by mixing together the ingredients listed in the proportions shown

| Ingredient | Example 28 WT % | Example 29 WT % | Example 30 WT % | Example 31 WT % | Example 32 WT % |
|---|---|---|---|---|---|
| C12-14 alkyl-3-ethoxy sulfate[7] | 10.6 | 10.6 | 10.6 | 10.6 | 10.6 |
| Linear alkyl benzene sulfonate[13] | 0.8 | 0.8 | 0.8 | 0.8 | 0.8 |
| Neodol 45-8[9] | 6.3 | 6.3 | 6.3 | 6.3 | 6.3 |
| Citric Acid | 3.8 | 3.8 | 3.8 | 3.8 | 3.8 |
| $C_{12-18}$ Fatty Acids | 7.0 | 7.0 | 7.0 | 7.0 | 7.0 |
| Protease B[10] | 0.35 | 0.35 | 0.35 | 0.35 | 0.35 |
| Tinopal AMS-X[11] | 0.09 | 0.09 | 0.09 | 0.09 | 0.09 |
| Zwitterionic ethoxylated quaternized sulfated hexamethylene diamine[14] | 1.11 | 1.11 | 1.11 | 1.11 | 1.11 |
| Benzaldehyde[2] | 0.3 | 0.3 | 0.3 | 0.3 | 0.3 |
| Dequest 2010[15] | 0.17 | 0.17 | 0.17 | 0.17 | 0.17 |
| Organosiloxane Polymer from Examples 1-8 | 4.0 | — | — | | |
| Organosiloxane polymer- Silamer UR-50-50[4] | — | 4.0 | — | — | — |
| Organosiloxane polymer- (466-01-05[5a]) | — | — | 4.0 | — | — |
| Organosiloxane polymer- containing polyurethane and polyurea bonds (SLM 21-200[5b]) | — | — | — | 4.0 | — |
| Organosiloxane polymer- containing polyurethane and polyurea bonds (466-01-03[5a]) | | | | | 4.0 |
| Terpolymer of acrylamide/acrylic acid and methacrylamidopropyl trimethyl ammonium chloride[6] | 0.2 | 0.2 | 0.2 | 0.2 | 0.2 |

TABLE IV-continued

Examples 28-32: Exemplary Liquid Detergent Fabric Care Compositions: Liquid detergent fabric care compositions may be prepared by mixing together the ingredients listed in the proportions shown

| Ingredient | Example 28 WT % | Example 29 WT % | Example 30 WT % | Example 31 WT % | Example 32 WT % |
|---|---|---|---|---|---|
| Hydrogenated castor oil | 0.2 | 0.2 | 0.2 | 0.2 | 0.2 |
| Mica/TiO2[16] | | | 0.2 | 0.2 | 0.2 |
| Ethyleneglycol distearate[17] | 0.2 | 0.2 | 0.2 | | |
| Water, perfumes, dyes, and other optional agents/components | to 100% pH 8.5 | to 100% pH 8.5 | to 100% pH 8.5 | to 100% pH 8.5 | to 100% pH 8.5 |

[1]Available from Degussa Corporation, Hopewell, VA.

[2]Available from Sigma Aldrich, Milwaukee, WI.

[3]Organosiloxane polymer condensate made by reacting dicyclhexylmethanediisocyanate (HMDI), polytetramethyleneoxide and α, ω silicone diol available from Shin-Etsu Silicones, Akron, OH.

[4]Organosiloxane polymer condensate made by reacting dicyclhexylmethanediisocyanate (HMDI), and α, ω silicone diol, available from Siltech Corporation, Toronto, Canada.

[5a]Organosiloxane polymer condensate made by reacting hexamethylenediisocyanate (HDI), α, ω silicone diol and N-(3-dimethylaminopropyl)-N,Ndiisopropanolamine (Jeffcat ZR50) available from Wacker Silicones, Munich, Germany.

[5b]Polyurethane polymer condensate made by reacting hexamethylenediisocyanate (HDI), and α, ω silicone diol and 1,3-propanediamine, N'-(3-(dimethylamino)propyl)-N,N-dimethyl-Jeffcat Z130) commercially available from Wacker Silicones, Munich, Germany.

[5c]Organosiloxane polymer condensate made by reacting hexamethylenediisocyanate (HDI), α, ω silicone diol and 1,3-propanediamine, N'-(3-(dimethylamino)propyl)-N,N-dimethyl-(Jeffcat Z130) available from Wacker Silicones, Munich, Germany.

[6]Available from Nalco Chemicals, Naperville, IL.

[7]Available from Shell Chemicals, Houston, TX.

[8]Available from Degussa Corporation, Hopewell, VA.

[9]Available from Shell Chemicals, Houston, TX.

[10]Available from Genencor International, South San Francisco, CA.

[11]Available from Ciba Specialty Chemicals, High Point, NC.

[12]Available from Procter & Gamble.

[13]Available from Huntsman Chemicals, Salt Lake City, UT.

[14]Chelant, sold under the tradename LUTENSIT ®, available from BASF (Ludwigshafen, Germany) and described in WO 01/05874.

[15]Available from Dow Chemicals, Edgewater, NJ.

[16]Available from Ekhard America, Louisville, KY.

[17]Available from Stepan Chemicals, Northfield, IL.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric care composition comprising a. from about 0.01% to about 20% by weight of an organosiloxane comprising less than 0.3 milliequivent/g of primary or secondary amino groups and at least one repeat unit having the structure of Formula (I):

Formula I

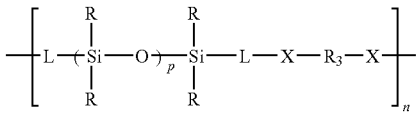

wherein:

(i) each X is

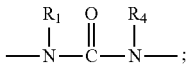

(ii) each L is —$(CH_2)$s-;

(iii) each R is independently selected from the group consisting of hydrogen, —$CH_3$, —$OCH_3$ or —OH;

(iv) each $R_1$ is H;

(v) each $R_3$ is a bivalent radical independently selected from the group consisting of aromatic, aliphatic and cycloaliphatic radicals with 2 to 30 carbon atoms, and combinations thereof; and (vi) each $R_4$ is independently selected from the group consisting of $C_1$-$C_8$ alkyl or substituted alkyl groups, or combinations thereof, wherein at least 50% of the $R_4$ groups have one or more tertiary amino groups;

(vii) p is an integer of from about 2 to about 1000;

(viii) n is an integer of from about 1 to about 50; and b. from about 0.1% to about 50% by weight of the composition of a surfactant selected from the group consisting of anionic, cationic, amphoteric, nonionic surfactants, and combinations thereof; and c. a material comprising an aldehyde and/or ketone group.

2. A fabric care composition according to claim 1 wherein the organosiloxane polymer optionally also comprises a urethane species and further comprises a second repeat unit having the structure of Formula II Formula III $$-[W-X-R_3-X]-$$

to produce a copolymer comprising the first and second repeat unit having the structure of Formula III Formula III $$\left[-L-(Si(R)(R)-O)_p-Si(R)(R)-L-X-R_3-X\right]_n-[W-X-R_3-X]_k-$$

wherein:

(i) each X is $$-N(R_1)-C(=O)-N(R_4)-;$$

(ii) each L is —$(CH_2)$s-;

(iii) each R is independently selected from the group consisting of hydrogen, —$CH_3$, —$OCH_3$ or —OH;

(iv) each $R_1$ is H;

(v) each $R_3$ is a bivalent radical independently selected from the group consisting of aromatic, aliphatic and cycloaliphatic radicals with 2 to 30 carbon atoms, and combinations thereof; and (vi) each $R_4$ is independently selected from the group consisting of $C_1$-$C_8$ alkyl or substituted alkyl groups, or combinations thereof, wherein at least 50% of the $R_4$ groups have one or more tertiary amino groups;

(vii) p is an integer of from about 30 to about 300;

(viii) n is an integer of from about 1 to about 50

(xi) k is an integer selected from 0 to about 100; and (xiii) W is an alkylene radical derived from an organic molecule containing at least two groups selected from the group consisting of amino groups, hydroxyl groups, carboxy groups and mixtures thereof.

3. A fabric care composition according to claim 1 wherein the material comprising an aldehyde and/or ketone group is present in an amount of about 0.0001% to about 2% by weight of the composition.

4. A fabric care composition according to claim 1 wherein the surfactant is selected from linear or branched alkyl benzene sulfonate, alkyl sulfate, alkyl ethoxy sulfate, alkyl ethoxylate, alkyl glyceryl sulfonate, quaternary ammonium surfactant, ester quaternary ammonium compound and mixtures thereof.

5. A fabric care composition according to claim 1 wherein the composition comprises an adjunct selected from the group consisting of delivery enhancing agents, fluorescent whitening agents, enzymes, rheology modifiers, builders, and mixtures thereof.

6. A fabric care composition according to claim 1 wherein the composition comprises a delivery enhancing agent.

7. A fabric care composition according to claim 6 wherein the delivery enhancing agent is a cationic polymer with a net cationic charge density of from about 0.05 meq/g to about 23 meq/g.

8. The fabric care composition according to claim 1 wherein the composition comprises 0.01% to about 0.3% by weight of a stabilizer.

9. The fabric care composition according to claim 8 wherein the stabilizer is a crystalline, hydroxyl-containing stabilizing agent.

10. A fabric care composition according to claim 1 wherein the composition is in the form of a rinse-added composition.

11. A fabric care composition according to claim 1 wherein the composition is a laundry detergent.

12. A method of providing a benefit to a fabric comprising contacting the fabric with the fabric care composition of claim 1.

13. The composition of claim 1, comprising a silicone emulsion comprising said organosiloxane polymer said silicone emulsion having a Tau Value less than 5.

14. The composition of claim 1, further comprising from 1% to 49% by weight of the composition a quaternary ammonium compound suitable for softening fabric, and from 0.1% to 3% perfume.

15. The composition of claim 14, comprising wherein the organosiloxane polymer comprises a silicone emulsion comprising said organosiloxane polymer said silicone emulsion having a Tau Value less than 10.

16. A fabric treated with the composition of claim 15, said fabric having:

(a) a Friction Test Ratio from 0.85 to 0.89;

(b) a Compression Test Ratio from 0.70 to 0.86;

(c) a Bending Test Ratio from 0.39 to 0.64.

17. A fabric treated with the composition according to claim 1, said fabric having:

(a) a Friction Test Ratio from 0.83 to 0.90, alternatively from 0.85 to 0.89;

(b) a Compression Test Ratio lower than 0.86, alternatively from 0.70 to 0.86, alternatively from 0.73 to 0.86;

(c) a Bending Test Ratio lower than 0.67, alternatively from 0.35 to 0.67, alternatively from 0.39 to 0.64, alternatively from 0.44 to 0.64.

18. A fabric according to claim 17, said fabric having:

(a) a Friction Test Ratio from 0.85 to 0.89;

(b) a Compression Test Ratio from 0.70 to 0.86;

(c) a Bending Test Ratio from 0.39 to 0.64.

* * * * *

UNITED STATES PATENT AND TRADEMARK OFFICE

CERTIFICATE OF CORRECTION

PATENT NO. : 8,263,543 B2
APPLICATION NO. : 12/752860
DATED : September 11, 2012
INVENTOR(S) : Panandiker et al.

It is certified that error appears in the above-identified patent and that said Letters Patent is hereby corrected as shown below:

Column 45, Claim 2:

Line 5, delete "Formula III" and insert -- Formula II --.

Signed and Sealed this
Sixth Day of November, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,263,543 B2
APPLICATION NO. : 12/752860
DATED : September 11, 2012
INVENTOR(S) : Panandiker et al.

It is certified that error appears in the above-identified patent and that said Letters Patent is hereby corrected as shown below:

In the Claims:

Claim 1, Column 44
Line 60, after 50; insert -- (ix) s is an integer of from about 2 to about 8; --.

Signed and Sealed this
Thirteenth Day of August, 2013

Teresa Stanek Rea
*Acting Director of the United States Patent and Trademark Office*